US010253772B2

(12) United States Patent
Morton

(10) Patent No.: US 10,253,772 B2
(45) Date of Patent: Apr. 9, 2019

(54) PUMP WITH CONTROL SYSTEM INCLUDING A CONTROL SYSTEM FOR DIRECTING DELIVERY OF PRESSURIZED LUBRICANT

(71) Applicant: Stackpole International Engineered Products, Ltd., Mississauga, Ontario (CA)

(72) Inventor: Paul Morton, Mississauga (CA)

(73) Assignee: STACKPOLE INTERNATIONAL ENGINEERED PRODUCTS, LTD., Ontario (CA)

( * ) Notice: Subject to any disclaimer, the term of this patent is extended or adjusted under 35 U.S.C. 154(b) by 259 days.

(21) Appl. No.: 15/152,911

(22) Filed: May 12, 2016

(65) Prior Publication Data

US 2017/0328363 A1 Nov. 16, 2017

(51) Int. Cl.
*F04C 14/18* (2006.01)
*F04C 2/344* (2006.01)
(Continued)

(52) U.S. Cl.
CPC ..... *F04C 14/18* (2013.01); *F04C 2/344* (2013.01); *F04C 2/3448* (2013.01);
(Continued)

(58) Field of Classification Search
CPC ..... F04C 14/18; F04C 14/14; F04C 14/22; F04C 14/226; F04C 2/344; F04C 2/3448;
(Continued)

(56) References Cited

U.S. PATENT DOCUMENTS 4,693,081 A 9/1987 Nakamura et al.
6,763,797 B1 7/2004 Staley et al.
(Continued)

FOREIGN PATENT DOCUMENTS

JP 6053688 3/1985
JP 033986 1/1991
JP 06229378 8/1994

OTHER PUBLICATIONS

Written Opinion of International Searching Authority and International Search Report PCT/IB2017/052776 dated Aug. 11, 2017.

*Primary Examiner* — Philip E Stimpert
(74) *Attorney, Agent, or Firm* — Pillsbury Winthrop Shaw Pittman, LLP

(57) ABSTRACT

Provided is a variable displacement vane pump with a control slide and a first and second control chambers. Also, the pump has a control system for controlling delivery of pressurized lubricant to the chambers. The control system includes a control device configured for movement between at least a first control position and a second control position. The control device may include its own housing and/or include discs configured for relative movement. The pivot pin may include grooves for delivering a flow from the outlet to the control system. In the first control position, pressurized lubricant is delivered to the first control chamber and the second control chamber is vented, which increases the output flow of the pump. In the second control position, pressurized lubricant is delivered to the second control chamber and the first control chamber is vented, which decreases the output flow of the pump.

20 Claims, 34 Drawing Sheets

(51) Int. Cl.
*F04C 15/06* (2006.01)
*F04C 14/22* (2006.01)

(52) U.S. Cl.
CPC ..... *F04C 14/226* (2013.01); *F04C 15/06* (2013.01); *F04C 2240/30* (2013.01); *F04C 2240/811* (2013.01)

(58) Field of Classification Search
CPC .... F04C 15/06; F04C 2240/30; F04C 2/3446; F04C 14/20; F04C 14/223; F04C 15/0023; F04C 15/15; F04C 2240/80; F04C 2240/811; F01C 21/0836; F01C 21/0863; F01C 21/106; F01C 21/108; F01C 21/2021; F01C 21/12; F01C 2021/14; F01C 2021/16; F01C 2021/1625; F01C 2021/1631
See application file for complete search history.

(56) References Cited

U.S. PATENT DOCUMENTS 6,790,013 B2 9/2004 Hunter et al.
7,344,361 B2 3/2008 Kiefer
7,862,306 B2 1/2011 Staley et al.
8,011,908 B2 9/2011 Williamson et al.
8,047,822 B2 * 11/2011 Shulver ..... F01M 1/16 417/220
8,057,201 B2 11/2011 Shulver et al.
8,317,486 B2 11/2012 Williamson et al.
8,342,817 B2 1/2013 Fujita et al.
8,342,826 B2 1/2013 Fujita et al.
8,348,646 B2 1/2013 Fujita et al.
8,444,395 B2 5/2013 Tanasuca et al.
8,512,006 B2 8/2013 Hunter
8,597,003 B2 12/2013 Krug et al.
8,602,748 B2 12/2013 Armenio et al.
8,746,980 B2 6/2014 Oki et al.
9,097,251 B2 8/2015 Maffeis
2009/0101092 A1 * 4/2009 Ichinosawa ..... F04C 11/006 123/90.15
2009/0196780 A1 8/2009 Shulver et al.
2012/0093672 A1 4/2012 Stratulat et al.
2012/0183426 A1 7/2012 Maffeis
2013/0136641 A1 5/2013 Novi et al.
2013/0209302 A1 8/2013 Ono et al.
2015/0044083 A1 2/2015 Akatsuka et al.
2015/0218983 A1 8/2015 Watanabe et al.

* cited by examiner

SECTION C-C

SECTION C-C FIG. 9

SECTION D-D FIG-10

SECTION E-E FIG 11

SECTION E-E FIG. 12

SECTION F-F FIG. 13

SECTION A-A

SECTION C-C

SECTION D-D

SECTION E-E

PUMP WITH CONTROL SYSTEM INCLUDING A CONTROL SYSTEM FOR DIRECTING DELIVERY OF PRESSURIZED LUBRICANT

BACKGROUND

Field

The present invention is generally related to a variable displacement vane pump for providing pressurized lubricant to a system and a control system used in the same for directing delivery of pressurized lubricant therein.

Description of Related Art

Vane pumps are known for use for pumping fluids or lubricants, such as oil, to internal combustion engines. Some known systems may utilize a single control chamber for moving lubricant. U.S. Patent Application No. 2013/0136641 and U.S. Pat. Nos. 8,602,748 and 8,746,980 illustrate examples of passively controlled variable vane pump having one control chamber, each of which is hereby incorporated in their entirety. Other types of pumps are disclosed in U.S. Pat. Nos. 8,047,822, 8,057,201, and 8,444,395, which are also incorporated herein in their entirety. Some pumps, like those disclosed in U.S. Patent Application No. 2012/0093672 and U.S. Pat. No. 8,512,006, which are also incorporated by reference herein in their entirety, may include a control system or device for varying the displacement of the pump.

SUMMARY

It is an aspect of this disclosure to provide a variable displacement vane pump for delivering lubricant to a system. The pump includes a housing, an inlet for inputting lubricant from a source into the housing, an outlet for delivering pressurized lubricant to the system from the housing, and a control slide displaceable about a pivot pin within the housing between a first slide position and a second slide position to adjust displacement of the pump through the outlet. The pump also includes a resilient structure biasing the control slide in a first direction towards the first slide position, and a rotor with at least one vane mounted in the housing and configured for rotation within and relative to the control slide. The at least one vane is configured for engagement within an inside surface of the control slide during rotation thereof. The pump further includes a first control chamber between the housing and the control slide provided on one side of the pivot pin such that supplying the lubricant to the first control chamber urges the control slide in the first direction towards the first slide position, and a second control chamber between the housing and the control slide provided on the other side of the pivot pin such that supplying the lubricant to the second control chamber urges the control slide in a second direction opposite the first direction towards the second slide position. Also, the pump has a control system for controlling delivery of the lubricant to the first and second control chambers of the pump. The control system includes a control device positioned adjacent to the pivot pin and that is mounted to permit pivotal movement between at least a first control position and a second control position. The control device has a feed port communicated to the lubricant and a vent port. In the first control position, the feed port of the control device is communicated to the first control chamber and the vent port of the control device is configured to vent the second control chamber, thereby moving the control slide in the first direction towards its first slide position and increasing the output flow of the pump. In the second control position, the feed port of the control device is communicated to the second control chamber and the vent port of the control disc is configured to vent the first control chamber, thereby moving the control slide in the second direction towards its second slide position and decreasing the output flow of the pump.

Other aspects, features, and advantages of the present invention will become apparent from the following detailed description, the accompanying drawings, and the appended claims.

DETAILED DESCRIPTION OF THE PREFERRED EMBODIMENT(S)

As detailed herein, a variable displacement vane pump has a control slide displaceable within its housing, and a first control chamber and a second control chamber each between the housing and the control slide, for receiving pressurized lubricant. A control system is provided in the housing for adjusting pump displacement. Pressurized outlet oil is used from the outlet (or other source of pressure) and is directed to the control system. A control device of the control system is moved between multiple control positions and, in some positions, to deliver lubricant to one of the control chambers, while the other control chamber is vented. Movement of the control device thus moves the control slide to either increase or decrease the output flow from the pump. In one embodiment, a feedback plate is further provided and enables a controlled return of the control slide to a neutral position.

As understood by one of ordinary skill in the art, "pump displacement" or "displacement" as used throughout this disclosure refers to a volume of liquid (lubricant) a pump is capable of moving during a specified period of time, i.e., a flow rate.

Figure 1:
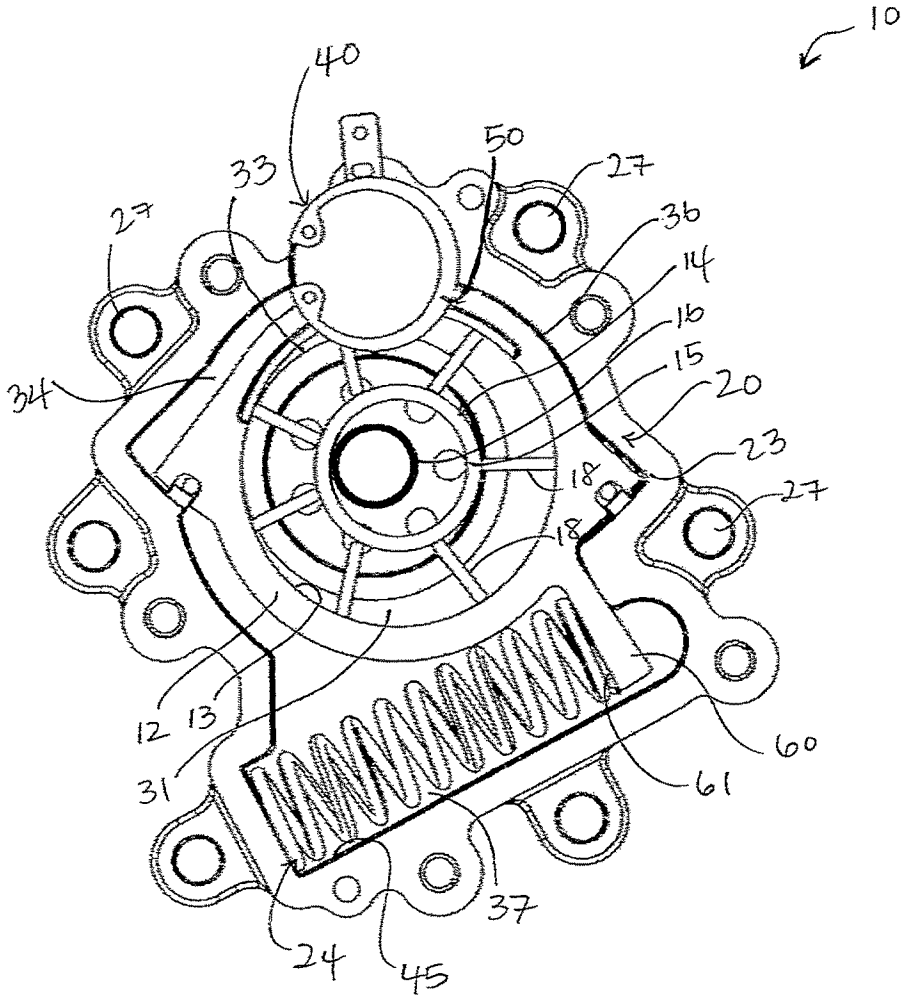
FIG. 1 is a schematic view of parts of a pump in accordance with an embodiment of this disclosure.

FIG. 1 is a perspective view of a pump 10 in accordance with an embodiment of the present disclosure. The pump 10 is a variable vane pump with a multi-chamber design. Pump 10 has a housing 20 with an inlet 30 (e.g., see FIG. 3) and an outlet 40. The pump inlet 30 receives fluid or inputs lubricant to be pumped (typically oil in the automotive context) from a source 26 (see FIG. 31) into the housing 20, and the pump outlet 40 (see FIG. 5A) is used for discharging or delivering the pressurized fluid or lubricant to the system, e.g., engine. (The terms "fluid" and "lubricant" are used interchangeably throughout this disclosure and not intended to limit this disclosure in any way.) A control slide 12 (also referred to as a "control ring," explained in greater detail below), a rotor 14 (or impeller), a shaft 16, and resilient structure 24 are provided in housing 20, as is known in the art. The pump inlet and outlet 30, 40 communicate to inlet and outlet ports 31, 33, which are open to the interior of the control slide 12 and disposed on opposing radial sides of the rotational axis of the rotor 14. As known in the art, the housing 20 has at least one inlet port 31 for intaking fluid to be pumped, and at least one outlet port 33 for discharging the fluid. The inlet port 31 and outlet port 33 each may have a crescent shape, and may be formed through the same wall located on one axial side or both axial sides of the housing (with regard to the rotational axis of the rotor 14). These structures are conventional, and need not be described in detail. The shape of the pump inlet 30 and/or pump outlet 40 is not intended to be limiting. Other configurations may be used, such as differently shaped or numbered ports, etc. Further, it should be understood that more than one inlet or outlet may be provided (e.g., via multiple ports).

Figure 2:
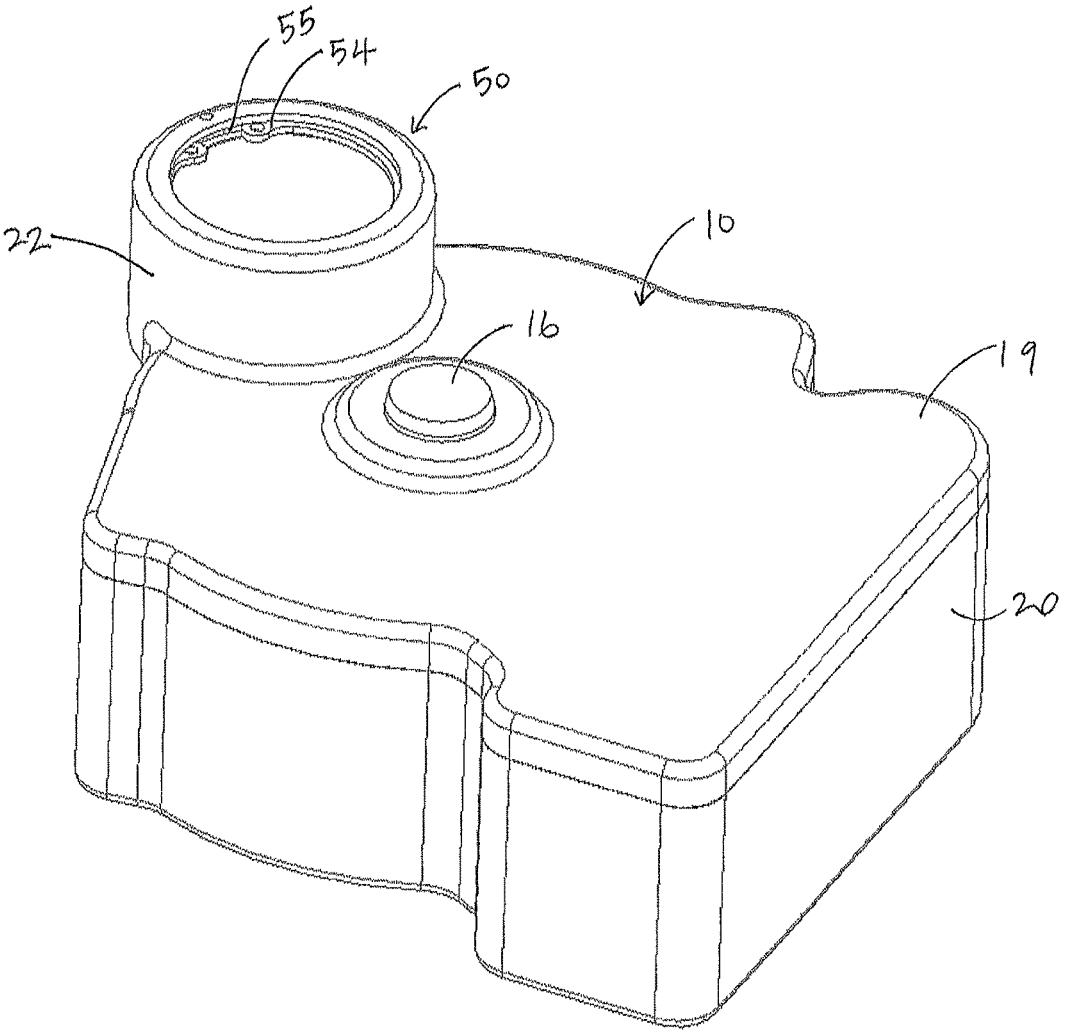
FIG. 2 is a perspective view of a housing and cover of the pump of FIG. 1 with a control system in accordance with an embodiment.

FIG. 2 shows a perspective view of an exemplary housing 20 and cover 19 of the pump of FIG. 1, with a control system as disclosed herein. The housing 20 may be made of any material, and may be formed by aluminum die cast, powdered metal forming, forging, or any other desired manufacturing technique. The housing 20 encloses internal chambers, also referred to herein as first control chamber 34 and second control chamber 36. In the drawings, the main shell of the housing 20 is shown (see also FIGS. 5A and 5B). Walls define axial sides of the internal chambers and a peripheral wall 23 extends around to surround the internal chambers peripherally. A cover 19 (e.g., shown in FIGS. 2-5, or FIGS. 17-20, for example) attaches to the housing 20, such as by fasteners 27 inserted into various fastener bores provided along the peripheral wall 23. The cover is not shown in FIG. 1 and FIG. 8, and FIG. 23, for example, so that some of the internal components of the pump can be seen. However, use of such cover 19 is generally well known and need not be described in greater detail herethroughout. The cover 19 may be made of any material, and may be formed by aluminum die cast, powdered metal forming, forging, or any other desired manufacturing technique. The drawings also show parts of and an underside of the cover 19, which helps enclose the internal chambers of the pump 10 along with the housing 20. A gasket or other seal(s) may optionally be provided between the cover 19 and peripheral wall 23 of the housing 20 to seal the internal chambers.

The housing 20 and cover 19 includes various surfaces for accommodating movement and sealing engagement of the control slide 12, which will be described in further detail below.

Figure 8:
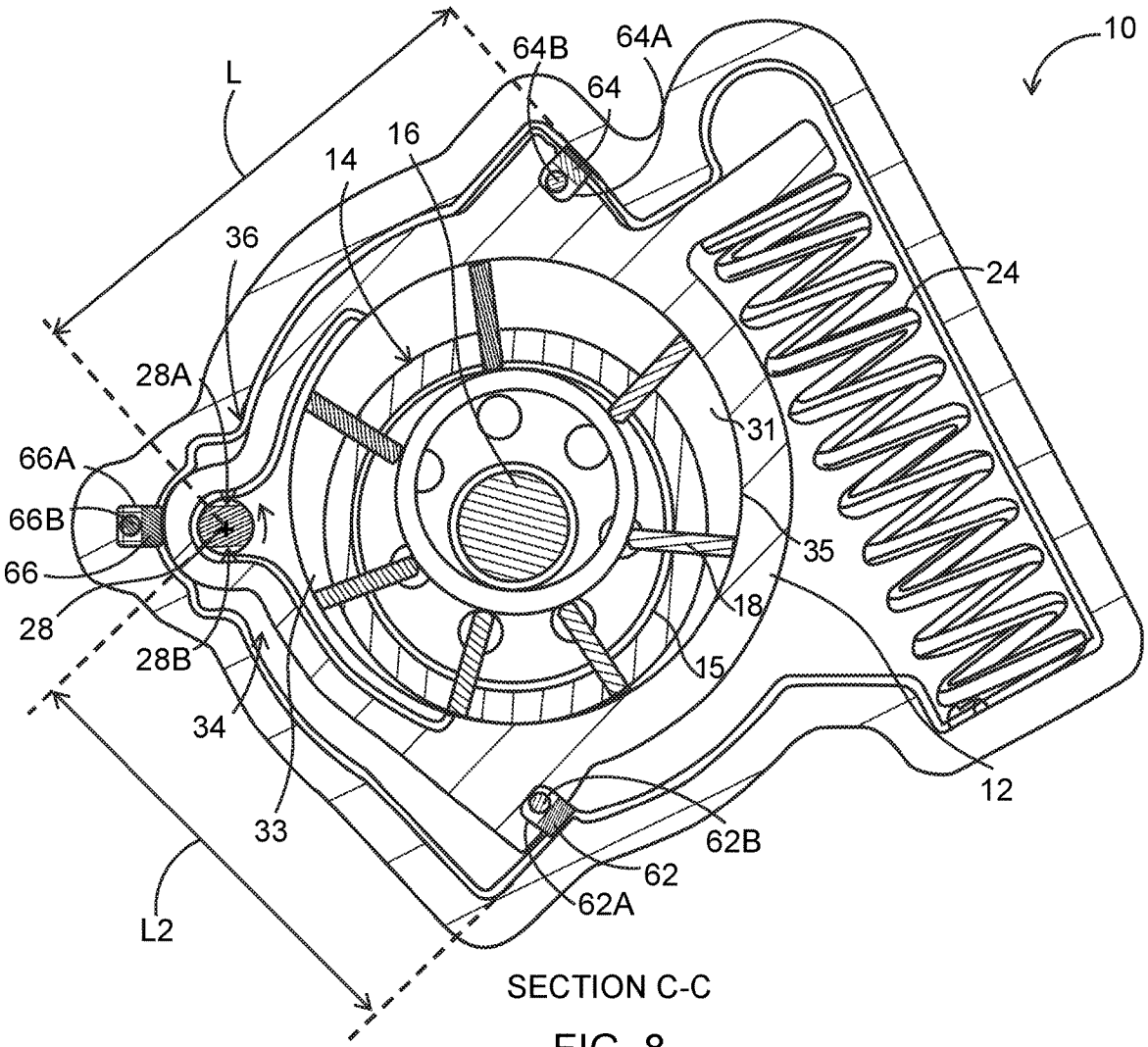
FIG. 8 is a plan view of parts of the pump of FIG. 2 at maximum displacement, taken along line 8-8 in FIG. 6, in accordance with an embodiment.
Figure 9:
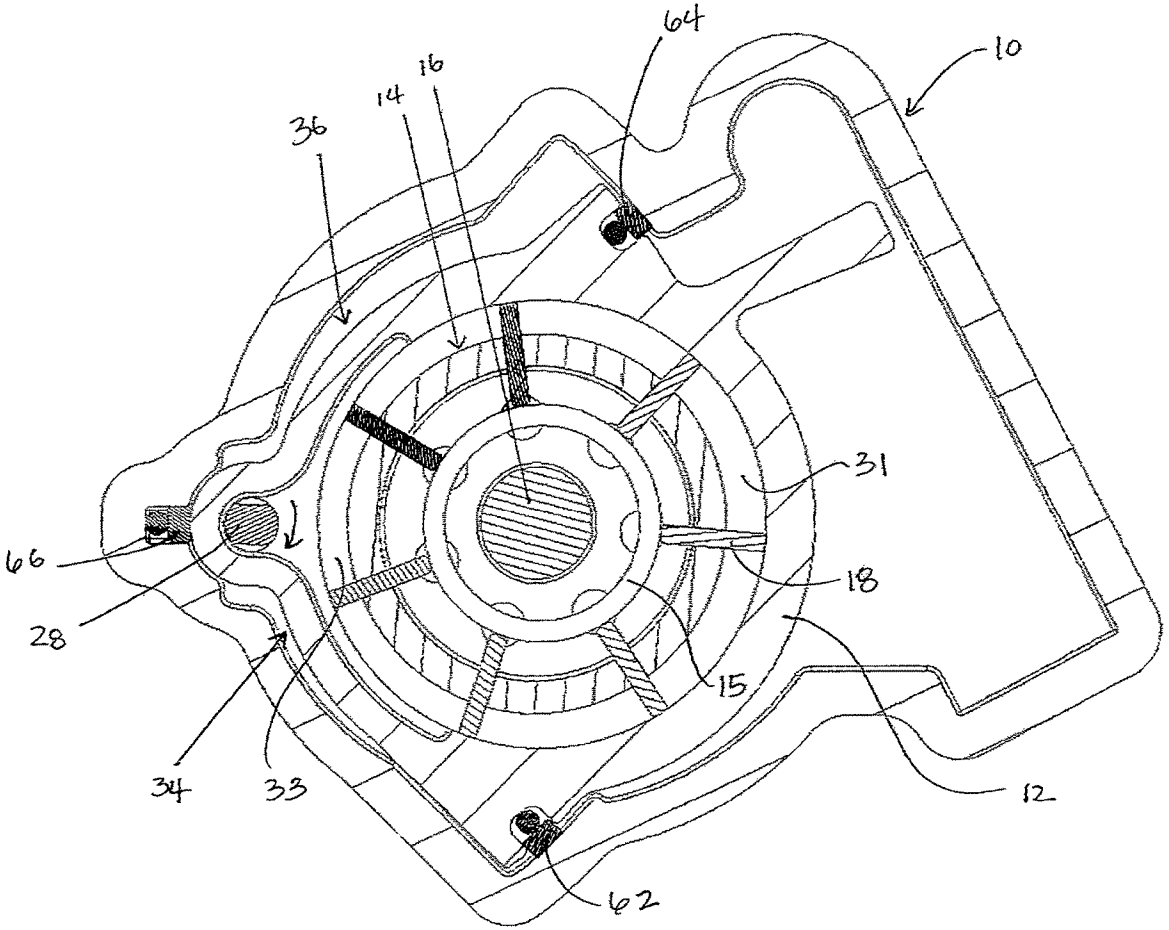
FIG. 9 is a plan view of parts of the pump of FIG. 2 at minimum displacement, in accordance with an embodiment.
Figure 23:
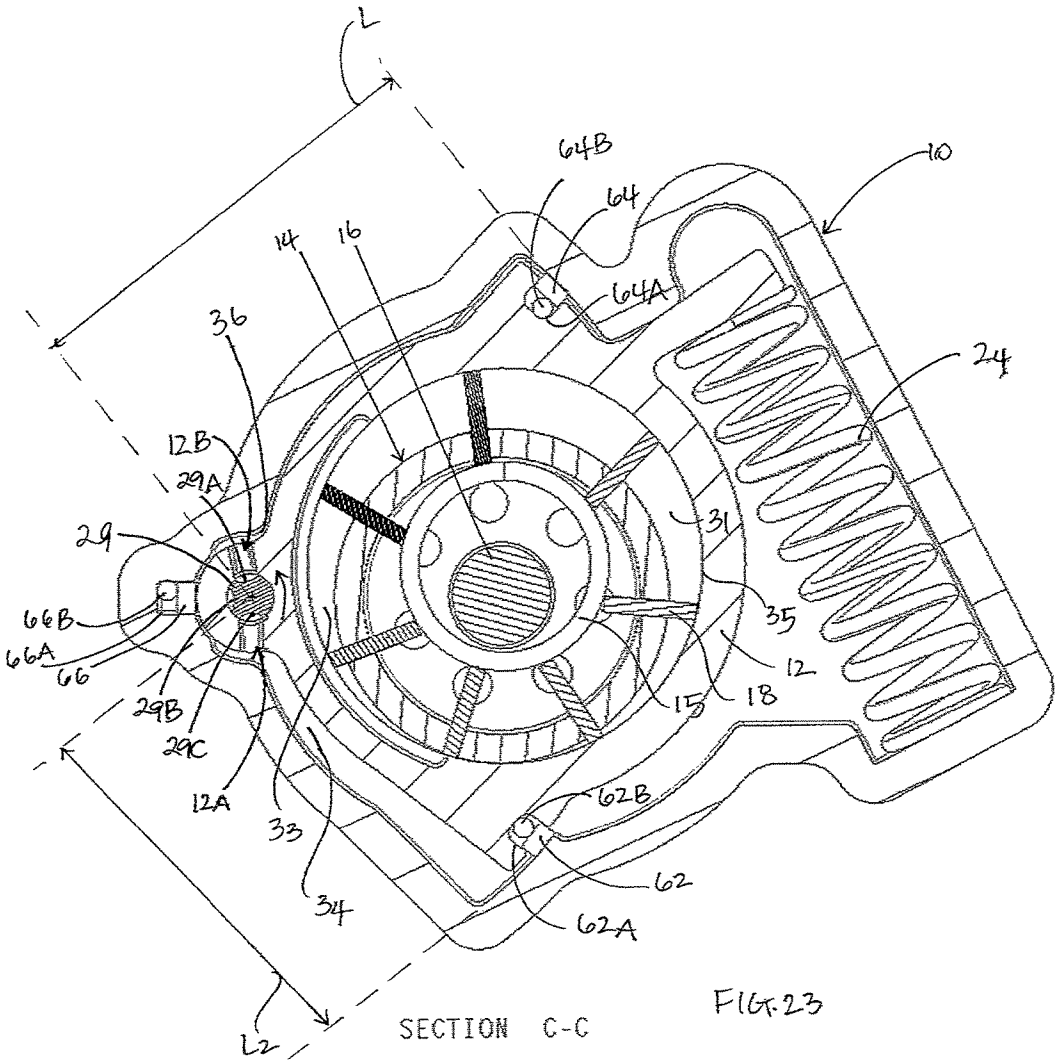
FIG. 23 is a plan view of parts of the pump of FIG. 17 at maximum displacement, taken along line 23-23 in FIG. 21, in accordance with an embodiment.
Figure 24A:
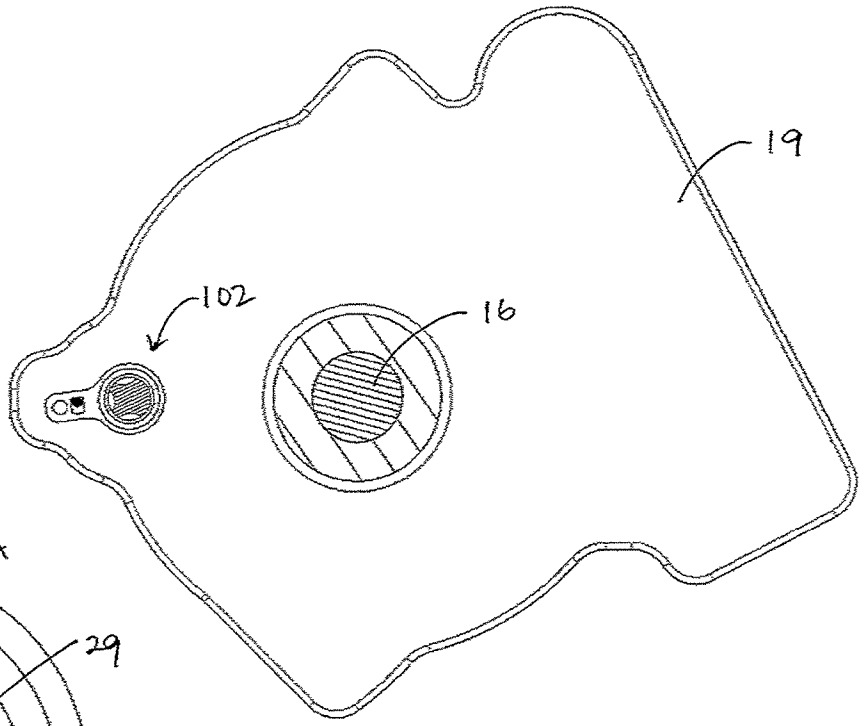
FIG. 24A is a sectional view taken along line 24-24 in FIG. 21 through a first part of a control device of the control system.
Figure 24B:
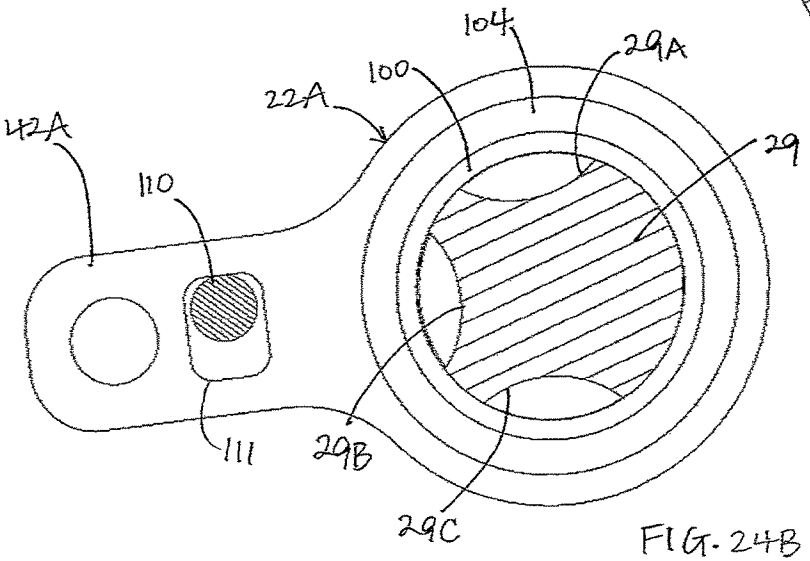
FIG. 24B is a detailed view of parts of the control device as shown in FIG. 24A.

The control slide 12 (or control ring) is displaceable within the housing 20 and relative to the cover 19 between a first slide position, a neutral/home position, and a second slide position to adjust displacement of the pump 10 through the outlet 40. In accordance with an embodiment, the control slide 12 is pivotally mounted and configured for pivotal displacement within the housing 20 between the first and second slide positions (e.g., from its neutral position). The first slide position is defined as a home position for maximum displacement. FIG. 8 and FIG. 23 each show an example of the slide in the first or maximum displacement slide position. The second slide position is defined as a position away from the first slide position or a position for minimum displacement, e.g., a reduced displacement position where the eccentricity between the control slide 12 and rotor axis is reduced. More specifically, it can include any number of positions that is away from the first slide position, and may, in one embodiment, include when the slide is close to a minimum displacement position, or may be the minimum displacement position. For example, the control slide 12 can be pivotally mounted relative to the first and second internal control chambers 34 and 36. When the control slide 12 pivots away from the first slide position, the control slide 12 can be considered to be in a second slide position, despite the angle of pivoting. FIG. 9 shows an example of the slide in a second or a minimum displacement slide position.

Specifically, in an embodiment wherein the control slide 12 pivots, a pivot pin 28 (or pivot pin 29) or similar feature may be provided to guide the pivoting action of the control slide 12. The pivot pin 28 (or 29) can be mounted to the housing 20 and cover, and is free to pivot or rotate in the cover 19 and housing 20. The configuration of the pivotal connection of the control slide 12 in the housing 20 should not be limited. The control slide 12 is rotationally fixed to the pivot pin 28 (or 29) for pivoting along an axis. More specifically, in accordance with an embodiment, the pivot pin 28 or 29 is designed to be press fit within an opening of the control slide 12. Outer surface(s) of the pivot pin may be coupled and/or in contact with a surface of the control slide 12, for example.

The control slide 12 has an inside or inner surface 13 (e.g., see FIG. 1, FIG. 8, and FIG. 23) defining a rotor receiving space 35. The rotor receiving space 35 has a generally circular configuration. This rotor receiving space 35 communicates directly with the pump inlet 30 and outlet 40 via the inlet and outlet ports 31, 33 for drawing in oil, lubricant, or another fluid under negative intake pressure through the pump inlet 30, and expelling the same under positive discharge pressure out the pump outlet 40.

The rotor 14 (or impeller) is rotatably mounted in the housing 20 within the rotor receiving space 35 of the control slide 12. The rotor 14 is configured for rotation within and relative to the control slide 12. The rotor 14 has a central axis that is typically eccentric to a central axis of the control slide 12 (and/or rotor receiving space 35). The rotor 14 is connected to a drive input in a conventional manner, such as a drive pulley, drive shaft, engine crank, or gear. As represented in FIG. 1, the rotor 14 is connected to the shaft 16.

The rotor 14 has at least one radially extending vane 18 mounted to the rotor 14 for radial movement. Specifically, each vane 18 is mounted at a proximal end in a radial slot in the central ring 15 of the rotor 14 in a manner that allows them to slide radially. Centrifugal force may force the vane(s) 18 radially outwardly to engage and/or maintain engagement between distal end(s) of the vane(s) and the inside or inner surface 13 of the control slide 12 during rotation thereof. This type of mounting is conventional and well known. Other variations may be used, such as springs or other resilient structures in the slots for biasing the vanes radially outwardly, and this example is not limiting. Thus, the vane(s) 18 can be sealingly engaged with the inner surface 13 of the control slide 12 such that rotating the rotor 14 draws fluid in through the inlet 30 by negative intake pressure and outputs the fluid out through the outlet 40 by positive discharge pressure. Because of the eccentric relationship between the control slide 12 and the rotor 14, a high pressure volume of the fluid is created on the side where the outlet port 33 leading to the pump outlet 40 is located, and a low pressure volume of the fluid is created on the side where the inlet port 31 leading to the pump inlet 30 is located (which in the art are referred to as the high pressure and low pressure sides of the pump). Hence, this causes the intake of the fluid through the inlet 30 and the discharge of the fluid through the outlet 40. This functionality of the pump is well known, and need not be detailed further.

The control slide 12 can be moved (e.g., pivoted) to alter the position and motion of rotor 14 and its vane(s) relative to the inner surface 13 of the slide 12, and, thus, alter the displacement of the pump and distribution of lubricant through the outlet 40. The resilient structure 24 biases or urges the control slide 12 in a first direction towards its first slide position (or first pivotal direction or position, or a maximum displacement position). A pressure change in the outlet 40 can result in the control slide 12 moving or pivoting (e.g., centering) relative to the rotor 14, adjusting (e.g., reducing or increasing) displacement of the pump. The first slide position is the position or direction that increases the eccentricity between the control slide 12 and rotor axis. As the eccentricity increases, the flow rate or displacement of the pump increases. Conversely, as the eccentricity decreases, the flow rate or displacement of the pump also drops. In some embodiments, there may be a position where the eccentricity is zero, meaning the rotor and ring axes are coaxial. In this position, the flow is zero, or very close to zero, because the high and low pressure sides have the same relative volumes. Accordingly, in an embodiment, the first slide position of the control slide 12 is the position or direction for maximum offset or displacement of the pump 10 (e.g., see FIG. 8; FIG. 23), while the second slide position of the control slide 12 is the position or direction for reduced, limited, or minimal offset or displacement (e.g., see FIG. 9). Again, this functionality of a vane pump is well known, and need not be described in further detail.

In the illustrated embodiment, the resilient structure 24 is a spring, such as a coil spring or a leaf spring. In accordance with an embodiment, the resilient structure 24 is a spring for biasing and/or returning the control slide 12 to its default or biased position (first or home slide position for minimum eccentricity with the rotor 14). The control slide 12 can be moved against the spring or resilient structure to decrease eccentricity with the rotor 14 based on the pressure within the outlet 40 to adjust displacement and hence output flow. The housing 20 may include a receiving portion 37 for the resilient structure 24 (shown in FIG. 1), defined by portions of the peripheral wall 23, for example, to locate and support the structure (or spring). The receiving portion 37 may include one or more side walls 45 to restrain the resilient structure 24 against lateral deflection or buckling, and a bearing surface against which one end of the spring is engaged. The control slide 12 includes a radially extending bearing structure 60 defining a bearing surface 61 against which the resilient structure 24 is engaged, for example. Other constructions or configurations may be used.

Figure 31:
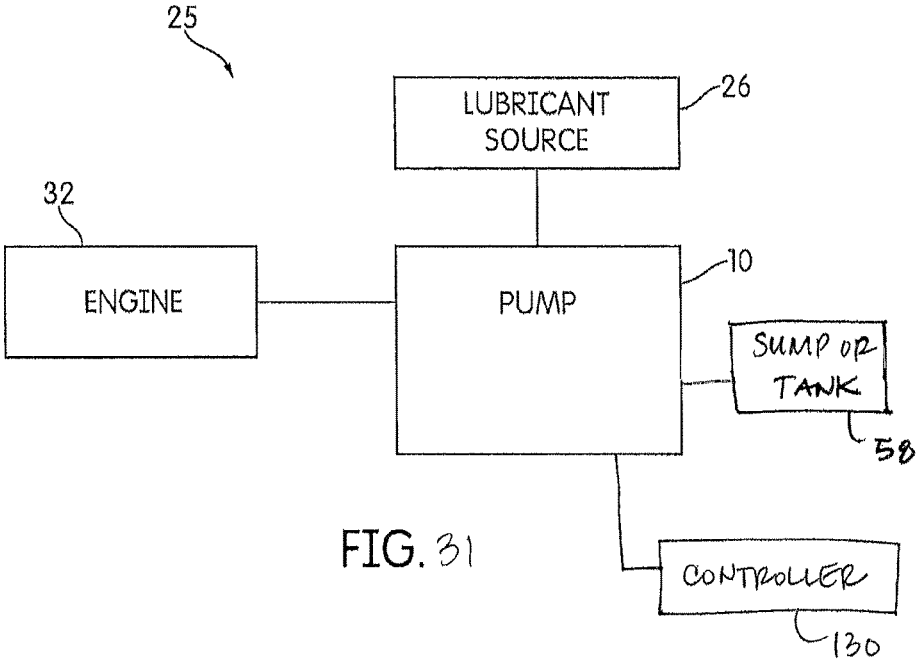
FIG. 31 is a schematic diagram of a system in accordance with an embodiment of the present disclosure.

FIG. 31 is a schematic diagram of a system 25 in accordance with an embodiment of the present disclosure. The system 25 can be a vehicle or part of a vehicle, for example. The system 25 includes a mechanical system such as an engine 32 (e.g., internal combustion engine) for receiving pressurized lubricant from the pump 10. The pump 10 receives lubricant (e.g., oil) from a lubricant source 26 (input via inlet 30) and pressurizes and delivers it to the engine 32 (output via outlet 40). A sump or tank 58 may be the lubricant source 26 that inlets to the pump 10.

Figure 10:
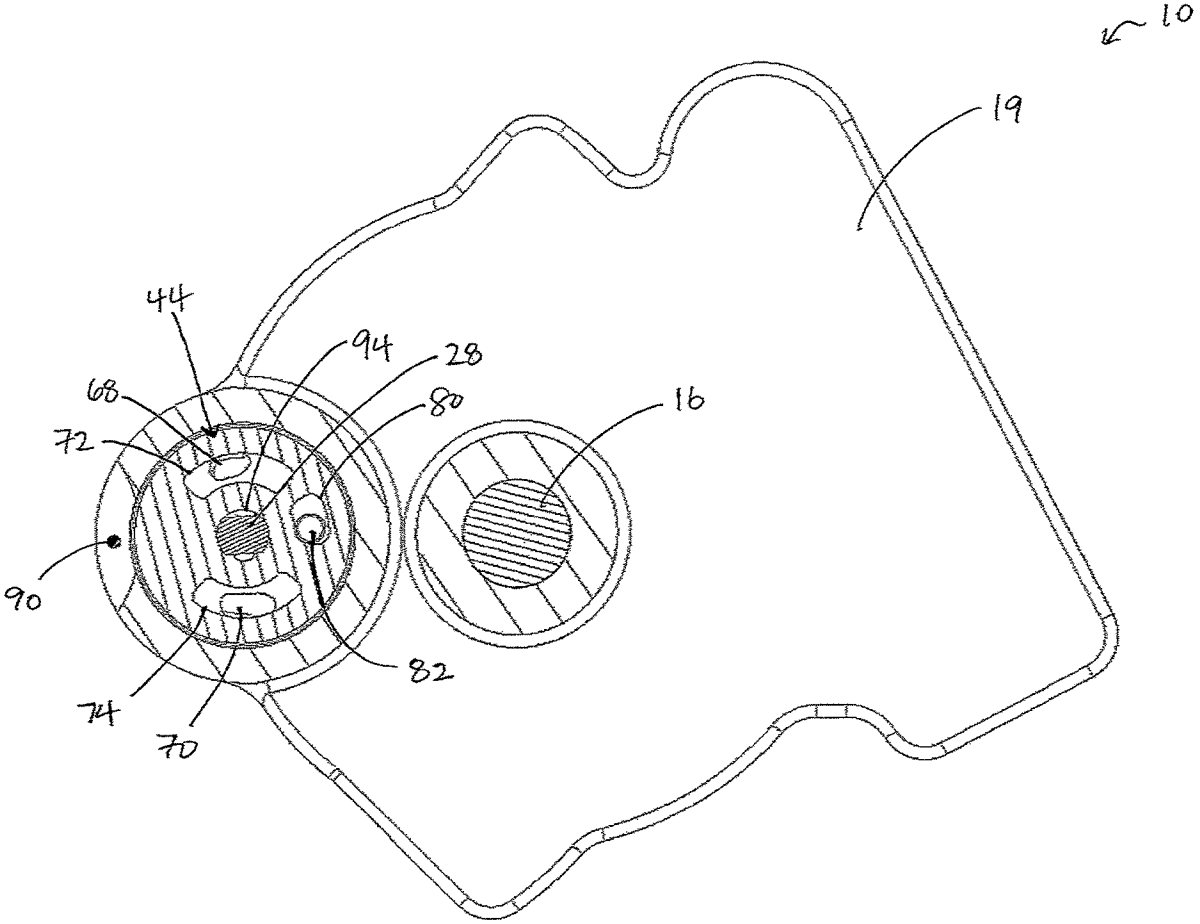
FIG. 10 is a sectional view taken along line 10-10 in FIG. 6 through a feedback plate of the control system.

Referring now to one exemplary embodiment, such as illustrated in FIG. 8 are the locations of the first control chamber 34 between the housing 20 and the control slide 12 and the second control chamber 36 between the housing 20 and the control slide 12 for receiving pressurized lubricant in the pump 10, relative to some of the pump parts. The first control chamber 34 is provided in the housing relative to a first side of the control slide 12, provided on one side of the pivot pin 28, while the second control chamber 36 is provided on an opposite, second side of the control slide 12, provided on the other side of the pivot pin 28. The first control chamber 34 and the second control chamber 36 each extend a length L and L2, as measured from the pivot pin 28, within the housing 20 on either side of the control ring 12. In one embodiment, L>L2. In another embodiment, L=L2. In yet another embodiment, L<L2. The first and second control chambers 34 and 36 are isolated from one another and do not communicate. The first control chamber 34 and the second control chamber 36 each have at least one port for receiving pressurized fluid. For example, the least one port may be communicated with the outlet 40 of the housing 20 for receiving the pressurized fluid under the positive discharge pressure. FIG. 10 illustrates an example of one embodiment of such ports noted as ports 68 and 70. Port 68 may be used to deliver pressurized fluid to the second control chamber 36 and port 70 may be used to deliver pressurized fluid to the first control chamber 34, for example. These ports 68 and 70 may be associated with a control system 50, described in greater detail below. Also described in greater detail below, in another embodiment associated with control system 102, ports that are in communication with the outlet 40 are provided in the slide 12. FIG. 23 shows ports 12A and 12B which are used to deliver pressurized fluid to the second control chamber 36 and to the first control chamber 34, respectively. The pressurized fluid may be received from other sources of positive pressure on the output side as well, such as the engine oil gallery and/or a diversion of the discharge pressure, and is not intended to be limiting.

If a positive pressure of force from the pressurized lubricant is applied or supplied to the first control chamber 34, the control slide 12 may be urged or forced in the first direction towards the first slide position (or first pivotal direction) to increase the pump output flow (i.e., by increasing the eccentricity). A positive pressure of force from the pressurized lubricant applied or supplied to the second control chamber 36, and thus applied to control slide 12, may urge the slide 12 in a second direction opposite the first direction towards its second slide position (or second pivotal direction) to decrease the pump output flow (i.e., by decreasing the eccentricity).

A plurality of seals, such as seals 62, 64, and 66 as shown in FIG. 8 and FIG. 23, may be provided between the housing 20/cover 19 and the control slide 12, for example. A first seal 62 may be provided in a groove 62A of the control slide 12 along with a slide seal support 62B adjacent to the first control chamber 34. A second seal 64 may be provided in a groove 64A of the control slide 12 along with a slide seal support 64B adjacent to the second control chamber 36. A third seal 66 may be provided in a groove 66A of the housing 20/cover 19 along with a slide seal support 66B adjacent to the pivot pin 28. Seals 62, 64 and 66 and slide seal supports 62B, 64B, and 66B assist in movement of the control slide 12 between its slide positions along the walls of the housing 20, while still maintaining a seal relative to the housing 20. The seals 62, 64, and 66 also assist in limiting leakage from each of the chambers 34, 36. Their position or length from the pivot pin 28 is determined based upon a moment balance with the resilient structure 24. The resilient structure 24 is designed to overcome friction and hysteresis from the seals 62, 64, and 66, yet allow a sufficiently low pressure in the control chamber to allow the control system to maintain authority to move the slide 12 to any position.

To control delivery of the pressurized fluid to the first and second control chambers 34 and 36, in accordance with one embodiment, a control system 50 is provided in the pump 10, shown in FIGS. 6-16B. The control system 50 may be provided in a chamber 22 formed in or with the cover 19, as shown in FIGS. 2-5, or in housing 20. In another embodiment, such as shown in FIGS. 17-27, a control system 102 is a device that is attached to the cover 19. The control system 50 may be provided adjacent to (or above) the pivot pin 28 and adjacent (e.g., in line with) to the outlet 40 of the pump, for example.

Figure 13:
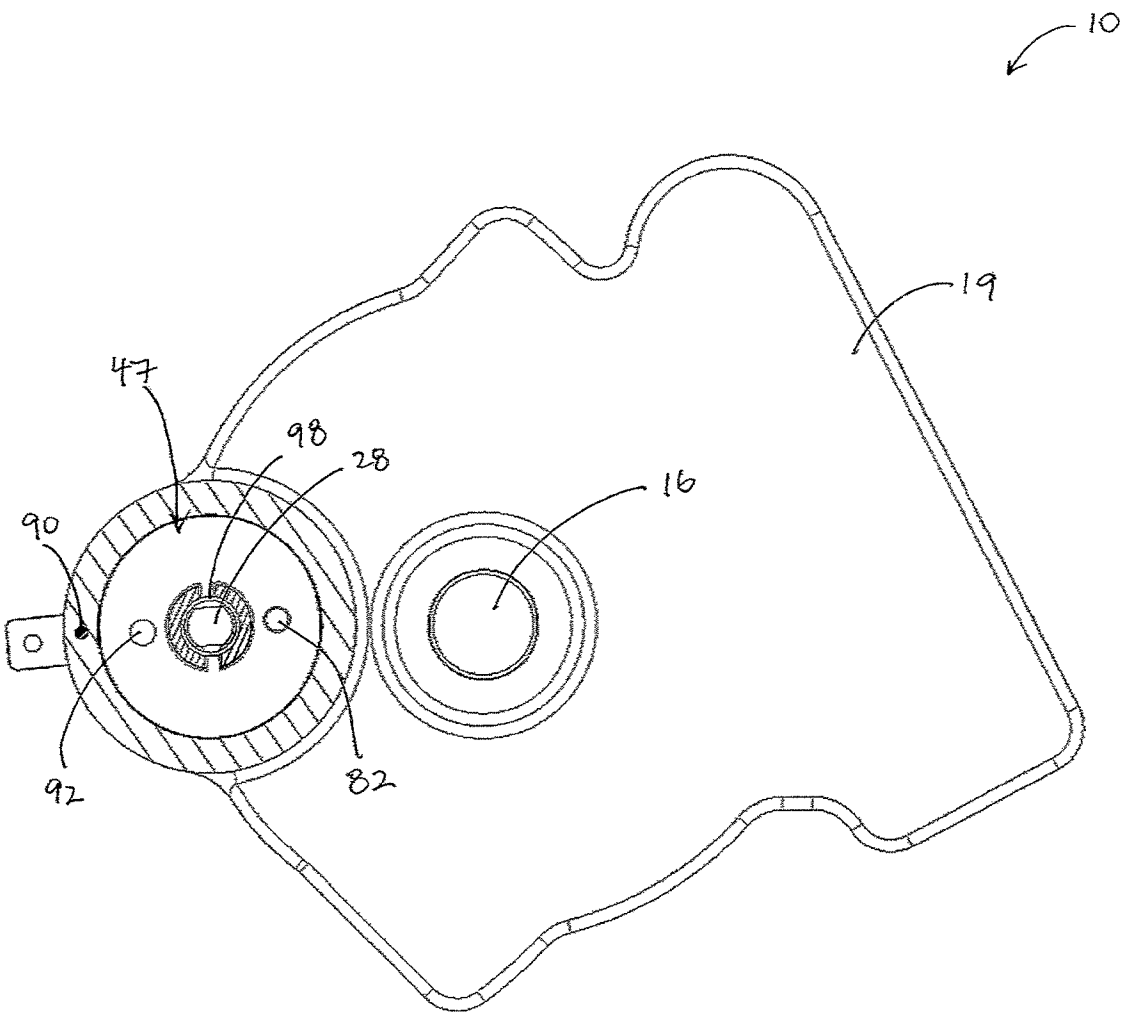
FIG. 13 is a sectional view taken along line 13-13 in FIG. 6 through another plate of the control system, in accordance with an embodiment.
Figure 14:
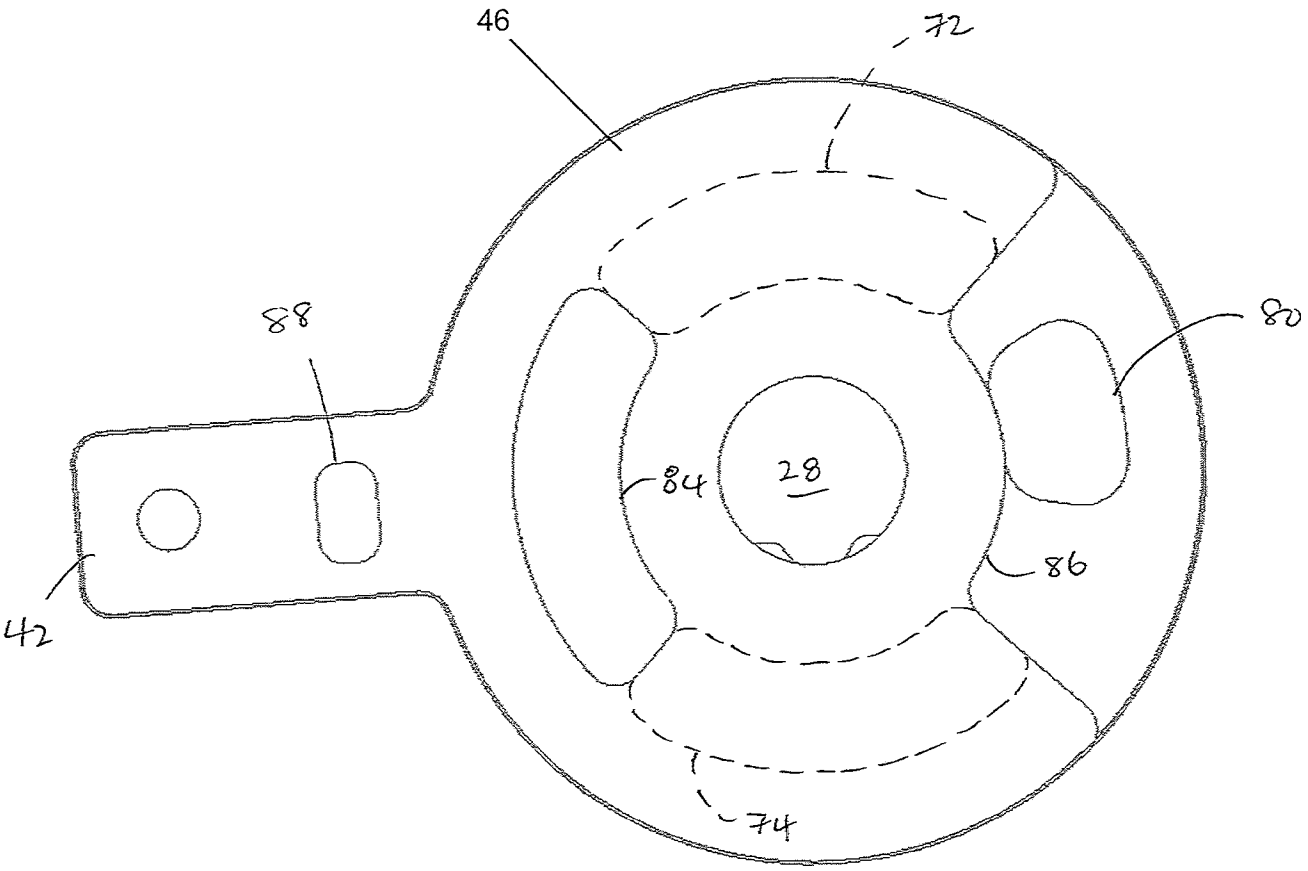
FIG. 14 is a schematic diagram illustrating the control plate of FIGS. 6-13 in a neutral control position.
Figure 15:
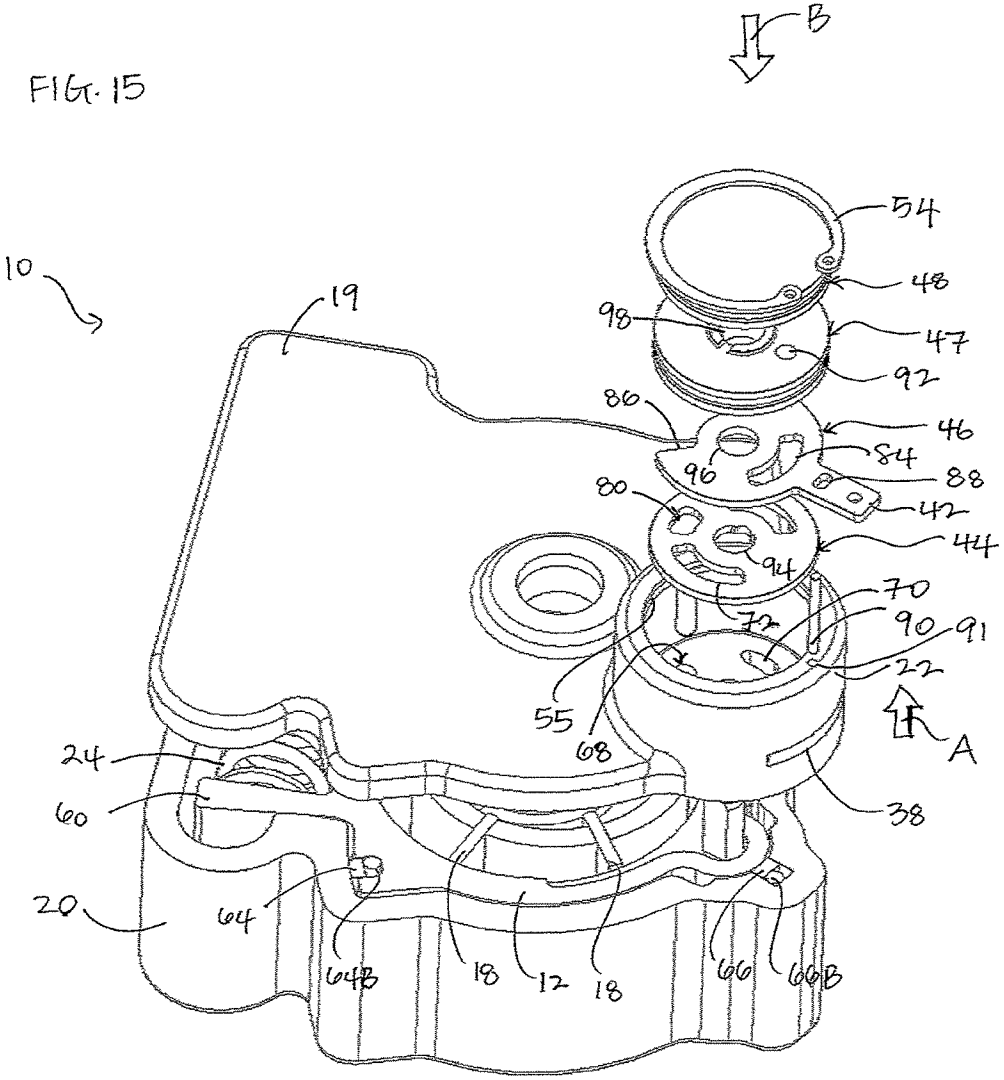
FIG. 15 is an exploded view of the parts of the housing, cover, and control system of FIG. 2.

Referring first to the illustrated embodiment of the control system 50 of FIGS. 6-16B, the control system 50 has a control device in a chamber 22 that has a feed port for communication with pressurized lubricant and a vent port 38 for venting or outputting lubricant. The feed port is used to direct lubricant to one of the control chambers 34, 36. The vent port 38 may be used to vent or output lubricant, from the other of the control chambers 34, 36, to the sump, tank 58, or lubricant source 26, for example. The vent port 38 may be formed from an opening provided through a wall of the chamber 22, as shown in FIG. 15, for example. The chamber 22 may be provided in the form of a cylindrical housing, for example. The housing may be substantially cylindrical, round, or oval, but need not be limited to such a shape.

The control system 50 as shown in this illustrative embodiment includes a feedback plate 44 and a control plate 46 positioned within a bore of the chamber 22. For non-limiting, illustrative purposes only, the plates 44 and 46 are shown in FIGS. 6-16B in the form of discs. Accordingly, for descriptive purposes only, the feedback plate thus referred to as a "feedback disc" herebelow, and the control plate is referred to as a "control disc". The feedback disc 44 and control disc 46 are axially aligned on an axis of the pivot pin 28 and provided within the chamber 22. The feedback disc 44 is rotationally fixed to the pivot pin 28 of the control slide 12 and thus in turn to the control slide 12, so that it pivots or moves along with pivotal movement of the control slide 12 about the pivot pin axis. The feedback disc 44 also pivots relative to the control disc 46. The control disc 46 is located on and rotates on the pivot pin 28.

The control disc 46 is constructed for pivotal movement about the pivot pin axis relative to the feedback disc 44 (or vice versa, the feedback disc 44 pivots relative to the control disc 46) between at least a first control position and a second control position. In some cases, the control disc 46 is configured for movement into a neutral position. As will be explained further below, when the control disc 46 is in the first control position, pressurized lubricant is delivered to the first control chamber 34, thereby moving the control slide 12 towards its first slide position, or maximum displacement, increasing the output flow of the pump 10. When the control disc 46 is in the second control position, pressurized lubricant is delivered to the second control chamber 36, thereby moving the control slide 12 towards its second slide position, or minimum displacement, decreasing the output flow of the pump 10. The control disc 46 is provided adjacent to the feedback disc 44 along the axis of the pivot pin 28.

The control system 50 may also include a pressure plate 47 and a cover plate 48 within chamber 22. The pressure plate 47 and cover plate 48 may be sealed within the chamber 22 using O-rings 52 that surround the plates 47 and 48 for securement against a wall of the chamber 22. Further, a retention clip 54 (see FIG. 7) is provided below the pressure plate 47 and cover plate 48 (e.g., adjacent to the cover plate 48) to secure cover plate 48 within the bore of chamber 22, thus to allow the pressure to compress pressure plate 47 towards the feedback and control plates 44, 46. The retention clip 54 may fit into a groove 55 (see FIG. 6) formed within the bore or fit along inner wall of the chamber 22, for example.

Figure 6:
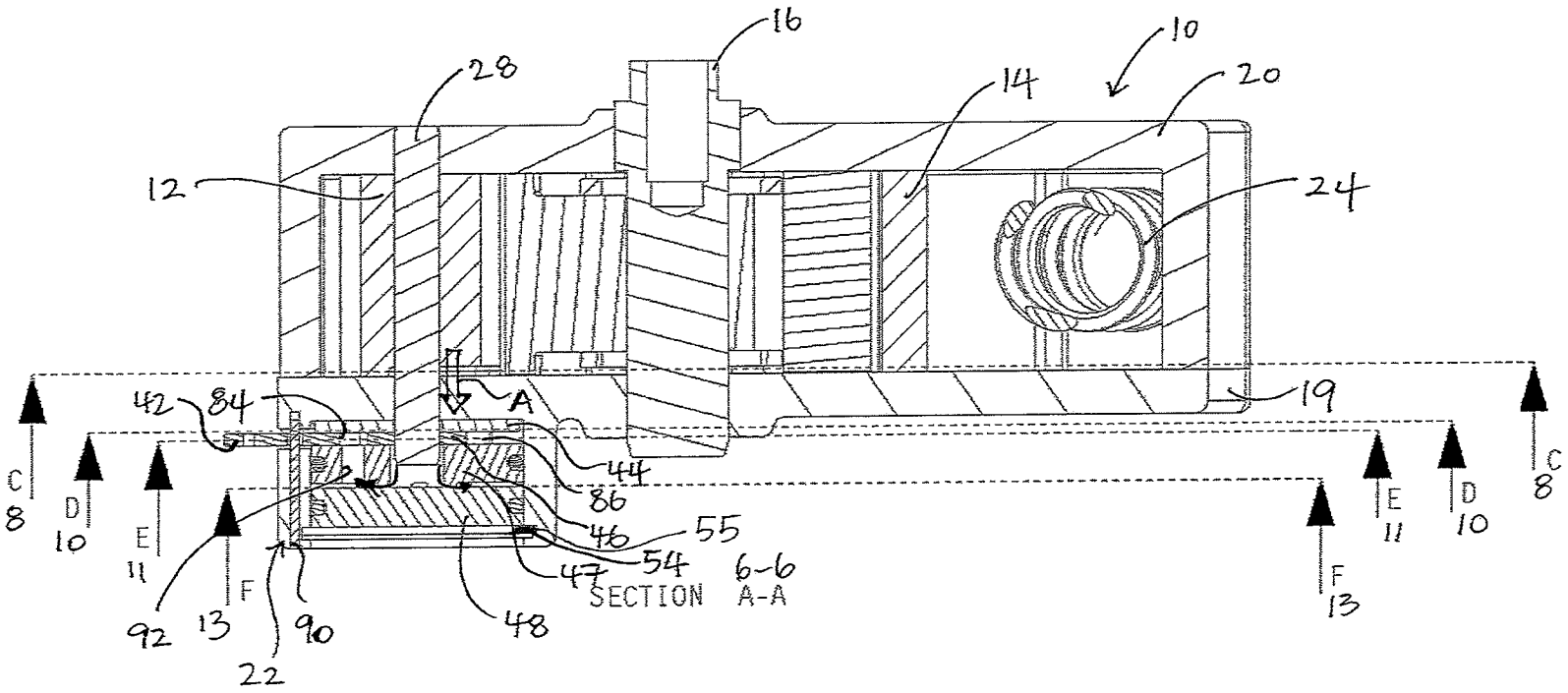
FIG. 6 is a horizontal sectional view taken along line 6-6 in FIG. 5 through the pump housing and control system.
Figure 7:
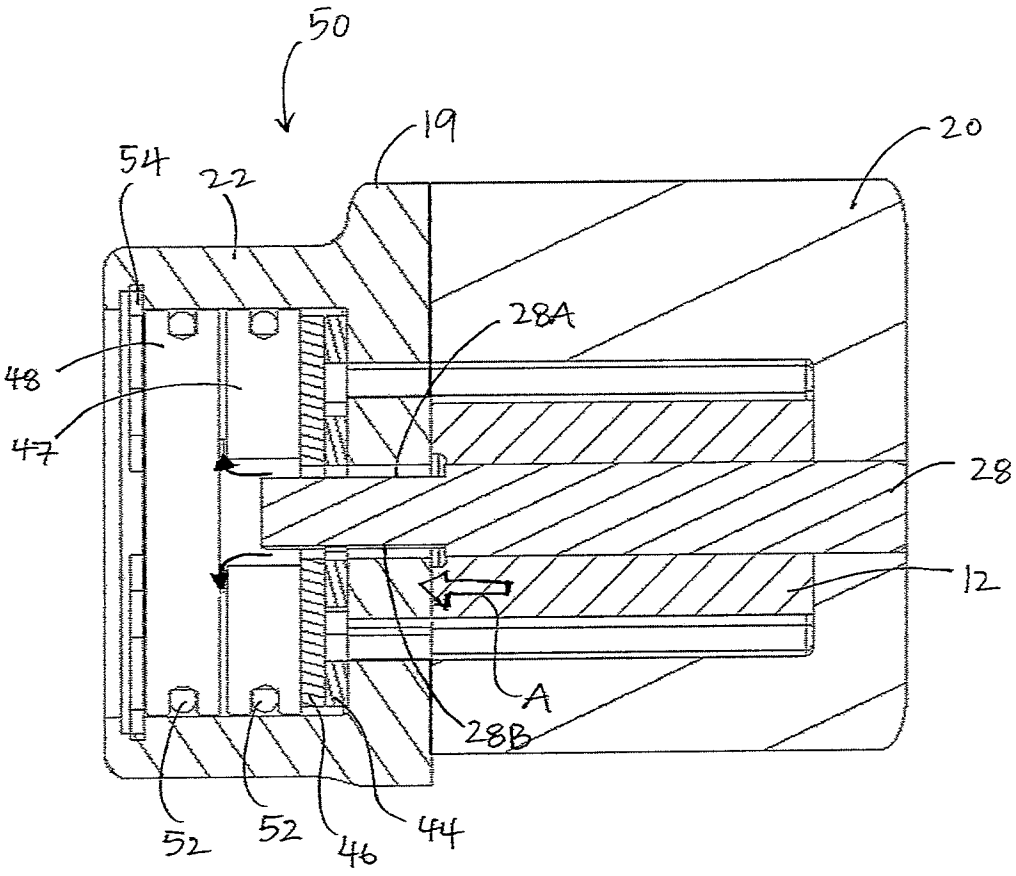
FIG. 7 is a vertical sectional view taken along line 7-7 in FIG. 5 through the control system and part of the pump housing.

As shown in FIG. 6, the pressure plate 47 may be provided adjacent to the control disc 46. The cover plate 48 is provided adjacent to the pressure plate 47. The pressure plate 47 includes a central opening 98 for receipt of an end of the pivot pin 28, as shown in FIGS. 7 and 14. The pressure plate 47 also includes delivery port 92 (also shown in FIG. 13) for delivering and feeding the received pressurized lubricant back to the control disc 46 (and, accordingly, to one of the chambers 34, 36). The cover plate 48 is spaced from the pressure plate 47 such that pressurized lubricant delivered between the plates 47 and 48 from the outlet port 33 holds the control plate 46 and feedback plate 44 together axially within the chamber 22. In addition, the pressure plate 47 includes an opening for receipt of a dowel 82. The dowel 82 is press-fit into the opening of the pressure plate 47, as shown in FIG. 13, in order to loosely orient the delivery port 92 of the pressure plate 47 for pressure feed of the pressurized lubricant towards the control disc 46 and such that the delivery port 92 remains in communication with ports of the control disc while still securing the pressure plate 47. As shown in FIG. 10 and in FIG. 15, for example, the feedback disc 44 includes an opening 80 through which the dowel 82 extends, but it remains clear of the feedback disc 44. The dowel 82 also remains clear of the control disc 46 via a vent port 86, which is further described below.

Additionally, in one embodiment, as seen in FIG. 6, a pin 90 for the control disc 46 may be provided within chamber 22, e.g., in a hole or slot 91. The pin 90 controls of the rotation of the control disc 46 between at least its first and second control positions, for example. The pin 90 may extend through a wall, hole or slot 91 of the chamber 22 and through an elongated hole 88 within the control disc 46. The pin 90 is configured to move between a first end and a second end of the elongated hole 88 of the control disc 46, which corresponds to a first control position and a second control position of the control disc 46.

Since the pivot pin 28 is press fit into the control slide 12, and so that pressurized lubricant may pass and be fed to the pressure plate 47, the pivot pin 28 may be shaped to include grooves therein, e.g., that are linear, to form flat sides 28A and 28B (also shown in FIG. 8). The grooves or sides of the pivot pin 28 are designed for receipt and delivery of pressurized fluid from the outlet port 33 side of the receiving space, and to direct therealong (in an axial direction) pressurized fluid to the control system, while the remaining surfaces about its perimeter or circumference are coupled to and/or in contact with the slide 12. The grooves may be spaced around the body of the pivot pin 28, and may or may not extend substantially an entire length of the pivot pin 28. For example, as seen in FIG. 7, the grooves may be designed to only extend along part of the length of the pivot pin 28. The grooves may be a flat, linear cut to form the flat sides 28A and 28B of pivot pin 28, or may be rounded or circular cuts, for example, as shown in pivot pin 29 (see, e.g., FIG. 23). Any number of grooves may be provided. In pivot pin 28, two grooves are provided. However, three or more grooves may be provided in accordance with another embodiment.

To further understand how the control disc 46 and feedback disc 44 of the control system 50 control delivery of the lubricant to the first and second control chambers 34 and 36, the assembly and configuration of the discs is further described here. As shown in FIG. 10, the feedback disc 44 has a first port 72 and a second port 74 that are configured to communicate to the working output pressure of the pump 10 (or some other source of pressure on the output side of the hydraulic circuit, like the engine gallery) and the tank pressure (which is basically the negative or zero pressure of the system on the intake side of the hydraulic circuit). More specifically, the ports 72 and 74 are configured to communicate (or feed back) the pressurized lubricant to one of the first and second control chambers 34 and 36 via ports 68 and 70, respectively. The feedback disc 44 includes a central opening 94 for receipt the pivot pin 28, as shown in FIGS. 10 and 14.

Figure 11:
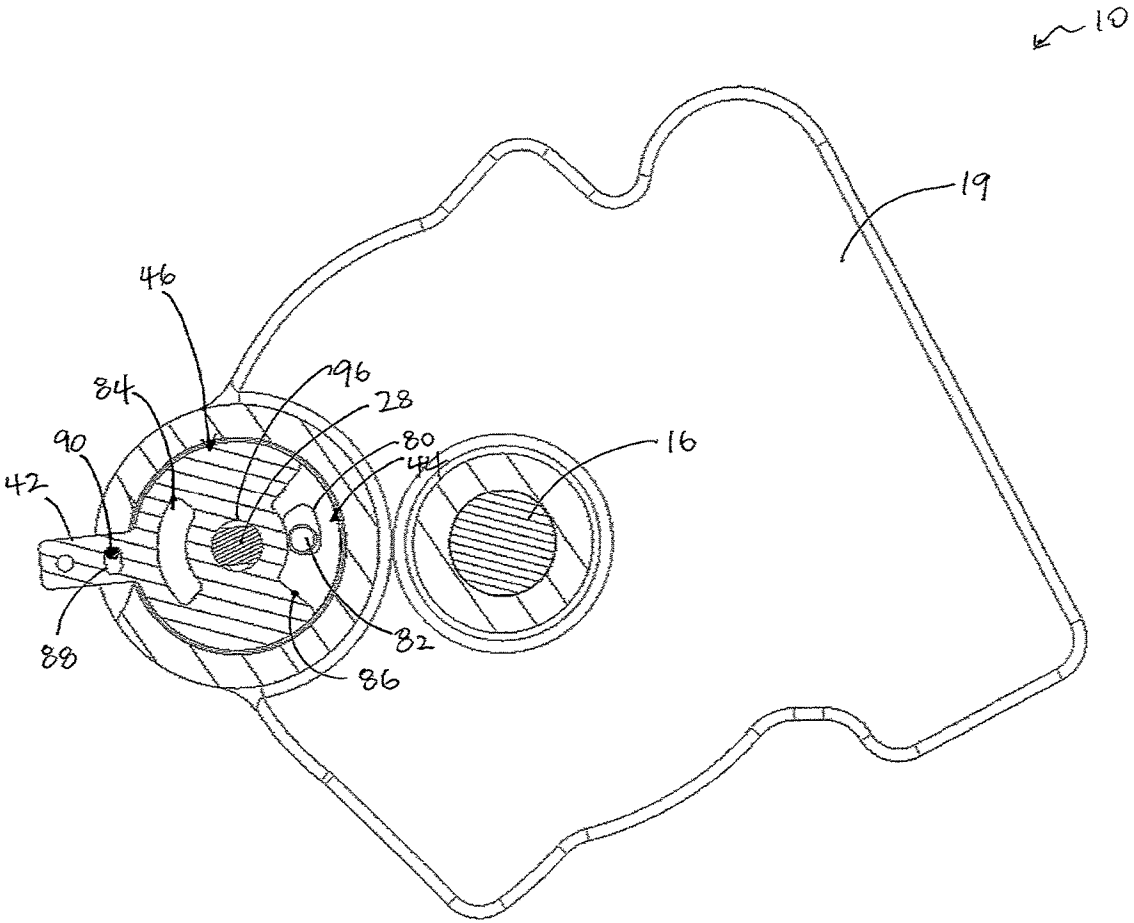
FIG. 11 is a sectional view taken along line 11-11 in FIG. 6 through a control plate of the control system, when the pump is at maximum displacement.
Figure 12:
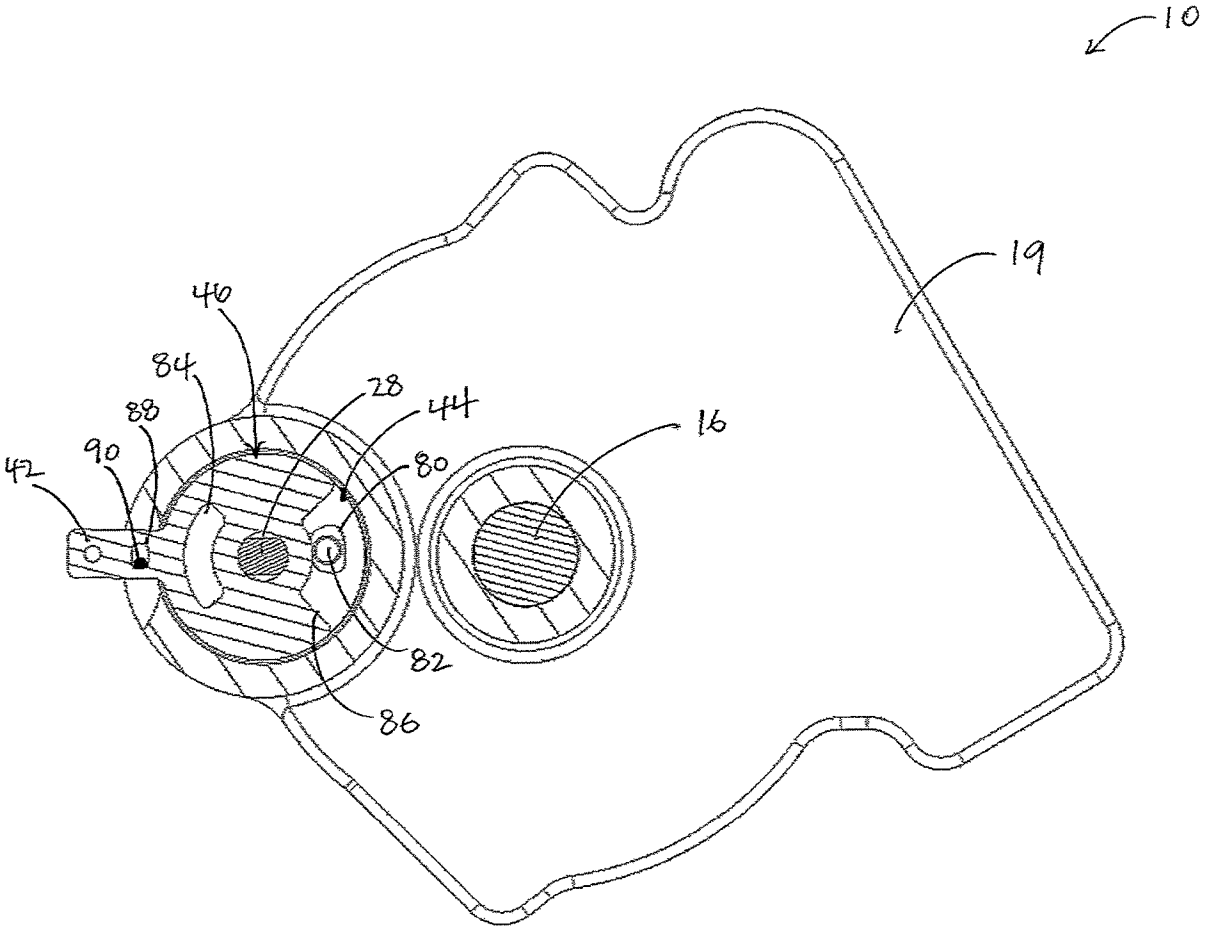
FIG. 12 is a sectional view of the control plate of the control system, when the pump is at minimum displacement.

The control disc 46 has a pair of ports 84 and 86, as shown in FIG. 11, for example, configured for controlling and enabling selective communication of the pressurized lubricant between one of the first and second control chambers 34 and 36 and one of the outlet and a sump or tank 58. Each of the ports 84 and 86 is associated with one of the ports 72 and 74 on the feedback disc 44. Port 84 is a pressure port or feed port for delivering pressurized lubricant towards the feedback disc 44. Port 86 is a vent port used to vent the pressurized lubricant to the tank 58/lubricant source 26, or act as negative intake pressure of the pump 10. The control disc 46 includes a central opening 96 for receipt the pivot pin 28, as shown in FIGS. 11 and 14. More specifically, in conjunction with the pivot pin 28, pressurized lubricant is configured for delivery to the control system 50, which in turn results in control of the delivery of the lubricant to the chamber 34 or 36. Pressurized fluid from outlet port 33 may flow or feed (upwardly) via the grooves or flat sides 28*a* and 28*b* of the pivot pin 28 towards the chamber 22, through openings 94 and 96 in the feedback disc 44 and the control disc 46, and thus towards plates 47 and 48 in the control system 50. The direction of flow of the pressurized fluid is represented by arrow A in the Figures. Referencing FIG. 7, for example, the pressurized fluid flows axially along the pin 28 towards and out on top of pressure plate 47 (which supplies pressure between plates 47 and 48 to hold the control disc 46 and feedback disc 44 axially together). The pressurized fluid is fed axially (back down) to the port 84 of the control disc 46 via a delivery port 92 in pressure plate 47.

Figure 16A:
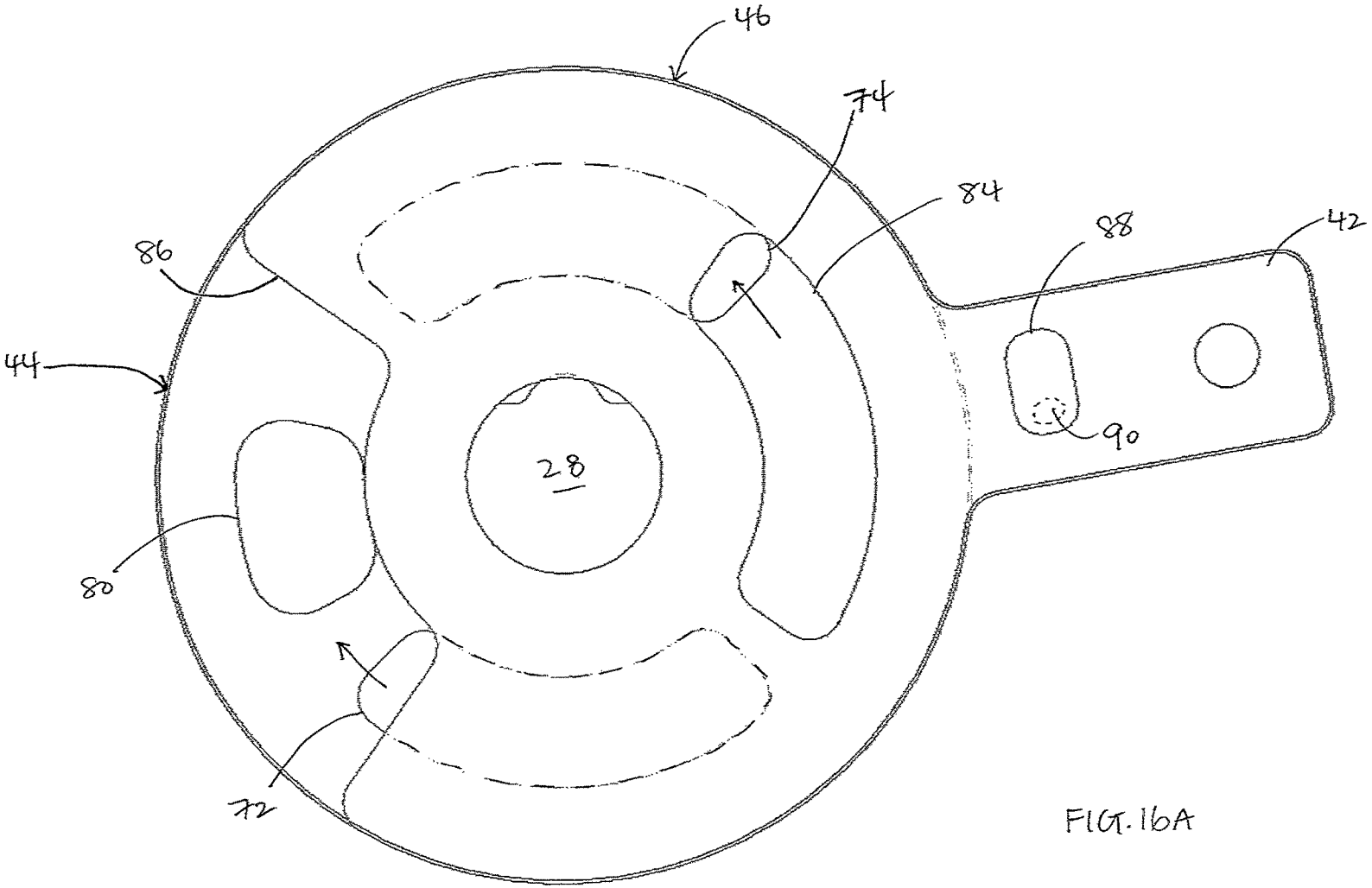
FIGS. 16A and 16B are schematic diagrams illustrating relative positions of the control plate and the feedback plate of the control system in a first control position (e.g., for increasing displacement) and a second control position (e.g., for decreasing displacement), respectively, for controlling delivery of pressurized lubricant to chambers in the pump, when viewed in a downward direction.
Figure 16B:
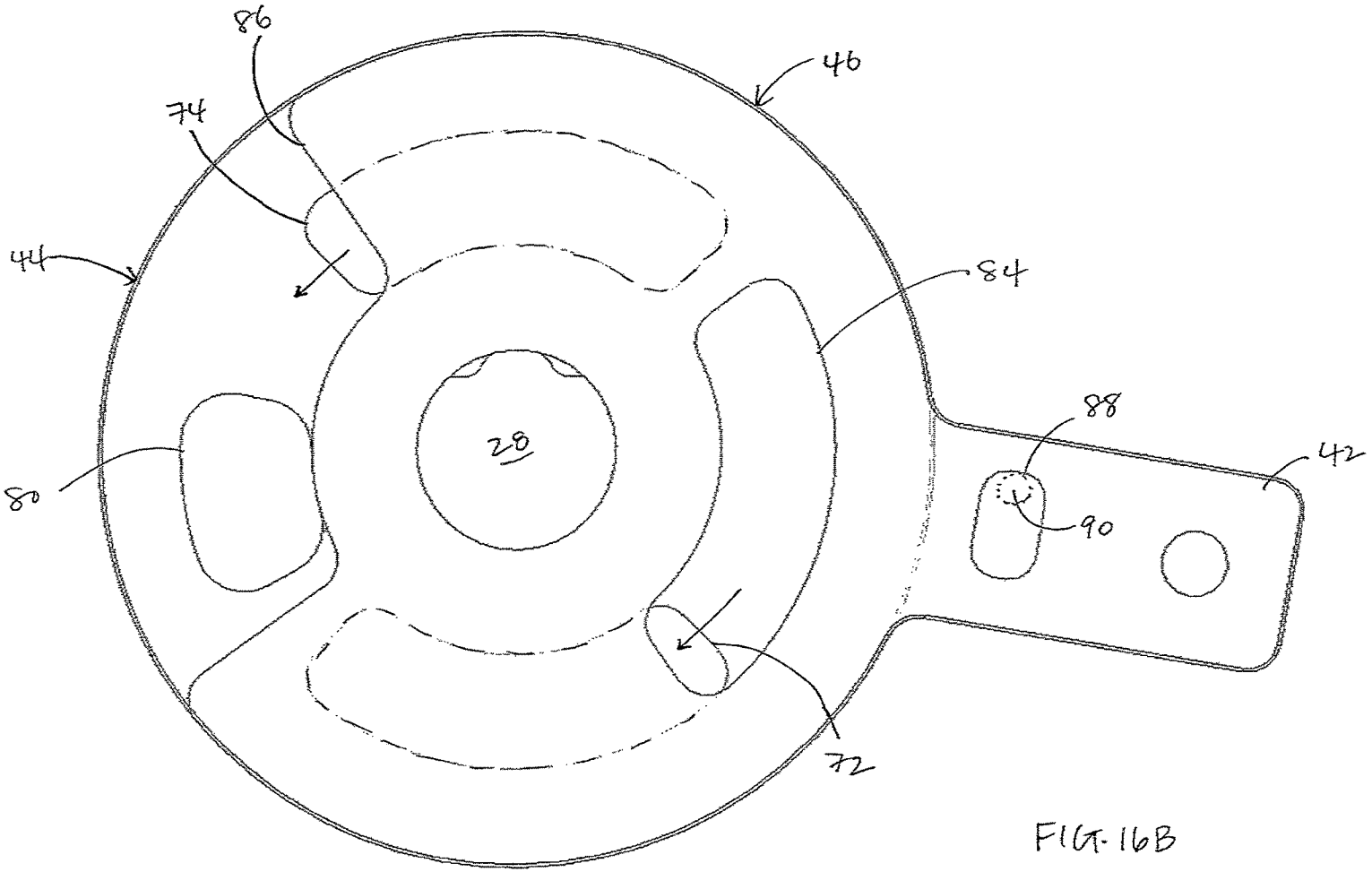
Figure 17:
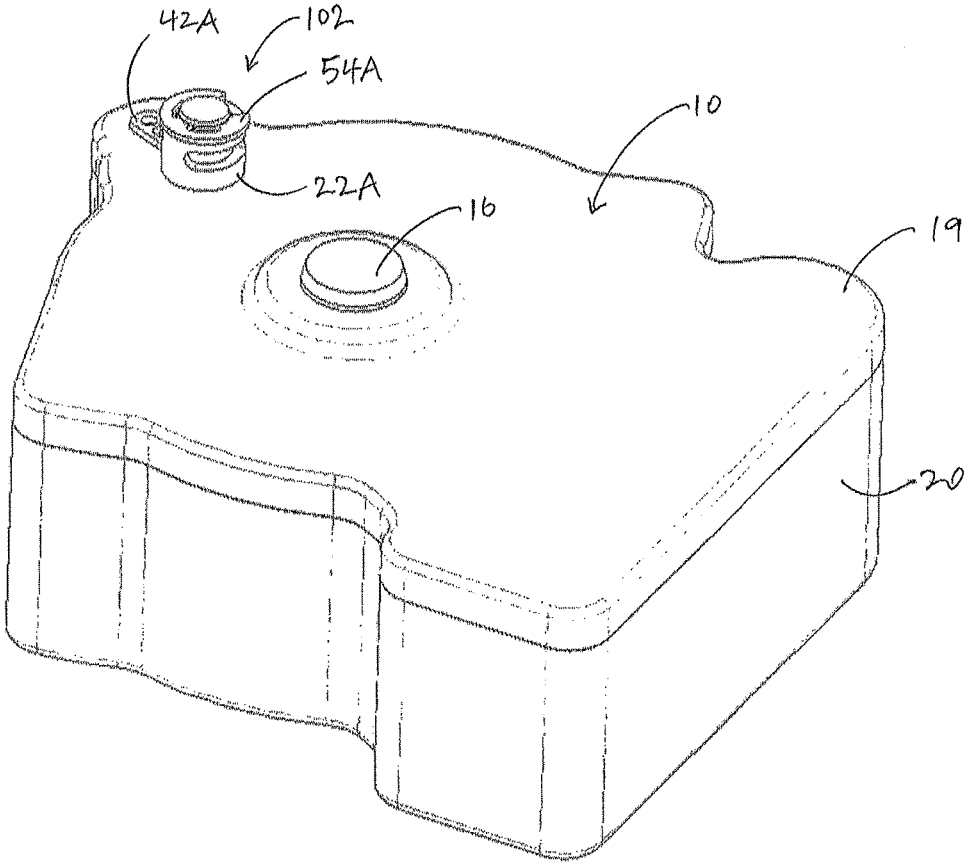
FIG. 17 is a perspective view of a housing and cover of the pump of FIG. 2 with an alternate control system in accordance with another embodiment.
Figure 18:
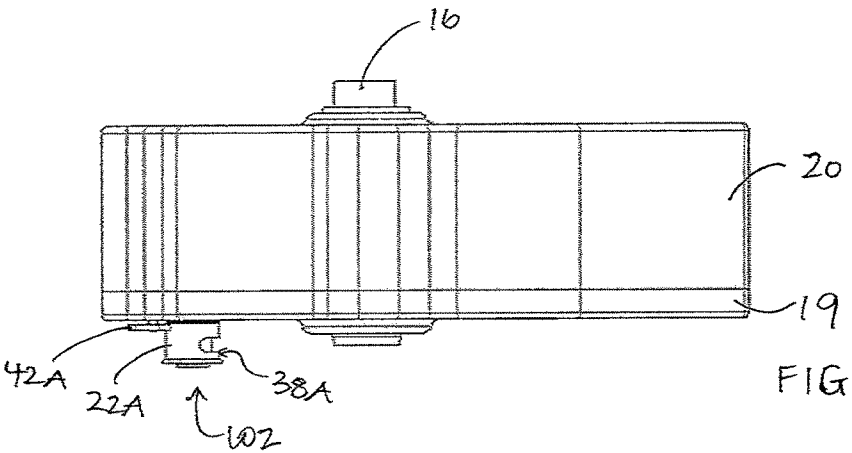
FIGS. 18, 19, and 20 are a side, end, and top views, respectively, of the housing and cover of the pump shown in FIG. 17.
Figure 20:
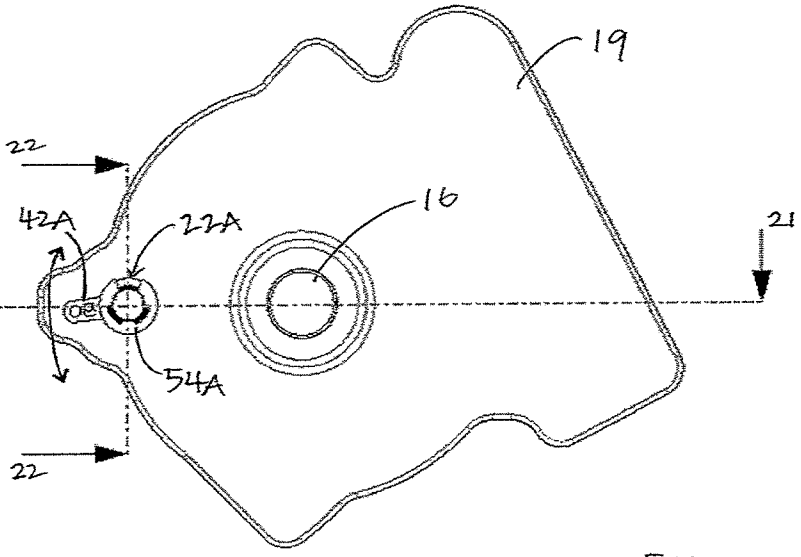
Figure 19:
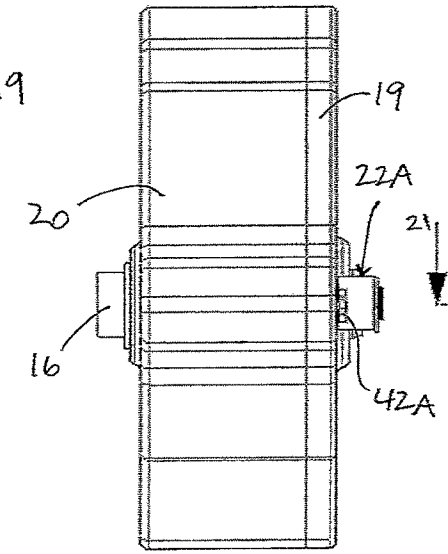

FIG. 14 illustrates the control system 50 and the control disc 46 when in a neutral control position. FIGS. 16A and 16B are illustrate relative positions of the control disc 46 and the feedback disc 44 of the control system 50 in a first control position (FIG. 16A) (e.g., maximum displacement) and a second control position (FIG. 16B)(e.g., minimum displacement), respectively, for controlling delivery of pressurized lubricant to chambers 34, 36 in the pump 10. The positions of the discs as shown in FIGS. 16A and 16B correspond to their positioning in each of the positions when viewed in a downward direction, i.e., when viewed in the direction indicated by arrow B in FIG. 15. In the first control position of FIG. 16A, e.g., when the control disc 46 is rotated towards or to a maximum displacement position (or counter-clockwise as depicted in the upward sectional view of FIG. 11) such that the pin 90 is provided at a first end of the elongated hole 88, one of the pair of ports of the control disc 46, e.g., feed port 84, communicates with the second port 74 of the feedback disc 44 such that the pressurized lubricant is delivered to the first control chamber 34 and the other of the pair of ports of the control disc 46, e.g., vent port 86, communicates with the first port 72 of the feedback disc 44 to vent the second control chamber 36 (see arrows in FIG. 16A). In this first control position, then, pressurized lubricant is delivered to the first control chamber 34 via port 70 (FIG. 10) to move the control slide 12 towards its first slide position to increase output flow of the pump, and the second control chamber 36 vents lubricant (e.g., to the tank 58 or source 26) via port 68. This may result in a maximum displacement by the pump 10, shown in FIG. 8. The seals 62, 64 slide along the inner walls of the housing 20 and seal 66 slides along the control slide 12 as the control slide 12 and feedback disc 44 are moved, e.g., counter-clockwise in FIG. 8, about the pivot pin 28.

In the second control position of FIG. 16B, e.g., when the control disc 46 is rotated towards or to a minimum displacement position (e.g., clockwise as depicted in the upward sectional view of FIG. 12) such that the pin 90 is provided at a second end of the elongated hole 88, as shown, one of the pair of ports of the control disc 46, e.g., port 84, communicates with the first port 72 of the feedback disc 46 such that the pressurized lubricant is delivered to the second control chamber 36 and the other of the pair of ports of the control disc 46, e.g., vent port 86, communicates with the second port 74 of the feedback disc 46 to vent the first control chamber 34 (see arrows in FIG. 16B), thereby moving the control slide 12 in the second direction towards its second slide position and decreasing the output flow of the pump. In this second control position, then, pressurized lubricant is delivered to the second control chamber 36 via port 68 to move the control slide 12 towards its second slide position to decrease output flow of the pump, and the first control chamber 34 vents lubricant (e.g., to the tank 58 or source 26) via port 70. This reduces displacement of the control slide 12 and may result in a minimum displacement by the pump, as shown in FIG. 9. The seals 62, 64 slide along the inner walls of the housing 20 and seal 66 slides along the control slide 12 as the control slide 12 and feedback disc 44 are moved, e.g., clockwise in FIG. 9, about the pivot pin 28.

Accordingly, the control disc 46 switches which of the first control chamber 34 and the second control chamber 36 are connected to the outlet port 33 of the pump and the other is connected to vent. This allows a small force to control the pump as the working pressure is provided by the outlet of the pump. Thus, by rotating the control disc 46, some of the pressure is effectively shifted over from the first control chamber 34 to the second control chamber 36 to in turn increase the displacement of the control slide 12 against the resilient structure 24.

In an embodiment, the control disc 46 is configured for pivotal movement into a third neutral position relative to the feedback disc 44 (i.e., in addition to the first position occurring after pressure to chamber 34 has moved the control slide 12 and feedback disc 44, and the second position occurring after the pressure to chamber 36 has moved the control slide 12 and feedback disc 44), as seen in FIG. 14, for example. In this neutral position, the ports 84 and 86 of the control disc 46 substantially limit communication of pressurized lubricant to the ports 72 and 74 of the feedback disc 44 such that little to no pressurized lubricant is delivered to either the first control chamber 34 or the second control chamber 36. In an embodiment, the feed port 84 of the control disc 46 is not communicated to either of the first and second ports 72, 74 of the feedback disc 44 to prevent delivery of the pressurized lubricant thereby to either of the first control chamber 34 or the second control chamber 36 via the control system.

The control system 50 returns to a neutral position (FIG. 14) by the fixed rotation of the feedback disc 44 along with the control slide 12. That is, in each case, the movement of the control slide 12 via the delivery of the pressurized lubricant to either chamber 34 or 36 will also move the feedback disc 44, since they are rotationally fixed together on pivot pin 28. The control slide 12 remains biased towards either of its positions until the ports 72 and 74 of the feedback disc 44 are placed in a neutral position relative the ports 84 and 86 of the control disc 46 because ports 72, 74, 84, 86 are not overlapping/communicating. For example, as the control slide 12 pivots clockwise, the feedback disc 44 is brought clockwise to a neutral position relative to the control disc 46, where bleedover ceases. That is, once the feedback disc 44 and control disc 46 return to a relatively neutral position, delivery of the pressurized fluid to the respective chamber is ceased. This allows for a change in the control slide position to be provided for, but the return of the feedback disc 44 to a neutral position enables a reliable cessation to the travel or movement of the control slide 12. Conversely, if the cessation of pressure delivery to the control chamber 34, 36 causes the slide 12 to move back in the opposite direction, the feedback disc 44 will pivot with it and re-establish the pressure communication to the control chamber 34, 36. Thus, a level of equilibrium is maintained.

In accordance with another embodiment, FIGS. 17-27 illustrate another control system 102 that may be provided in a housing 20 and cover 19 of the pump 10. For simplicity purposes only, similar parts as described and noted above with respect to FIGS. 6-14 have been labeled with the same or similar reference numbers in FIGS. 17-27. Accordingly, it should also be understood that the features previously noted above with respect to those parts similarly apply to each of the embodiments of FIGS. 12-17 and thus are not necessarily repeated below. Further, although an inlet and outlet may not be explicitly shown therewith, one of ordinary skill in the art will understand that the depictions in FIG. 1 and as previously shown and described with reference to FIG. 2 will similarly apply to the embodiment illustrated in FIGS. 17-20.

Figure 27:
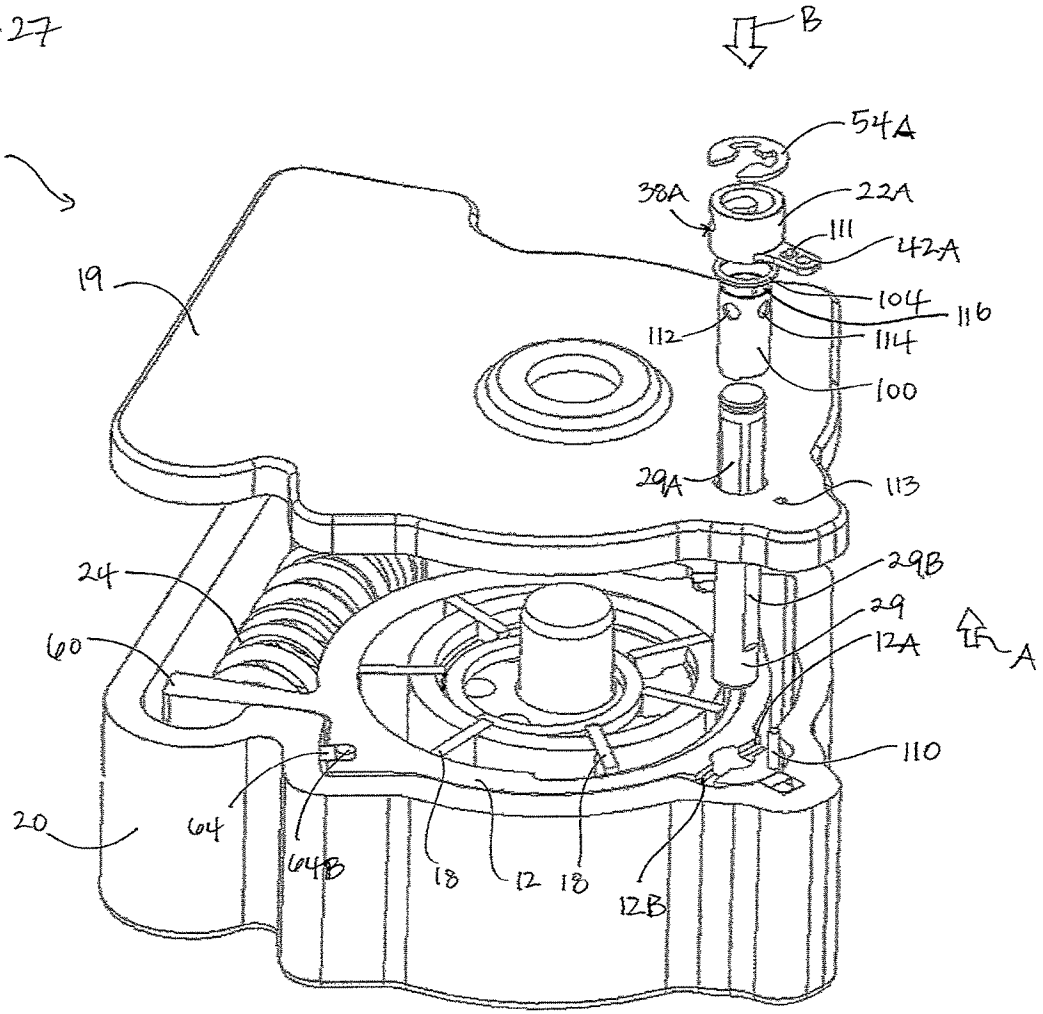
FIG. 27 is an exploded view of the parts of the housing, cover, and control system of FIG. 17.

The control slide 12 is rotationally fixed to a pivot pin 29 for pivoting along an axis. More specifically, the pivot pin 29 may be press fit into an opening of the control slide 12 such that its outer surface(s) are coupled to/in contact with a surface of the control slide. The control system 102 includes a control device 22A that is attached to the cover 19, adjacent to (or above) the pivot pin 29 and adjacent to the outlet 40, for example. The control device 22A may be provided in the form of a cylindrical housing, for example, that has a feed port for communication with pressurized lubricant and a vent port 38A (see FIG. 18) for venting or outputting lubricant to the sump, tank 58, or lubricant source 26, for example. The vent port 38A may be formed from an opening provided through a wall of the control device 22A, as shown in FIG. 27, for example. Although shown in cylindrical form, the housing of the control device 22A may be substantially cylindrical, round, or oval, but need not be limited to such a shape.

The cylindrical housing of the control device 22A is constructed for pivotal movement about the pivot pin axis between at least a first control position and a second control position. In some cases, the control device 22A is configured for movement into a neutral position. When the control device 22A is in the first control position, pressurized lubricant is delivered to the first control chamber 34, thereby moving the control slide 12 towards its first slide position, or maximum displacement, increasing the output flow of the pump 10. When the control device 22A is in the second control position, pressurized lubricant is delivered to the second control chamber 36, thereby moving the control slide 12 towards its second slide position, or minimum displacement, decreasing the output flow of the pump 10.

Figure 21:
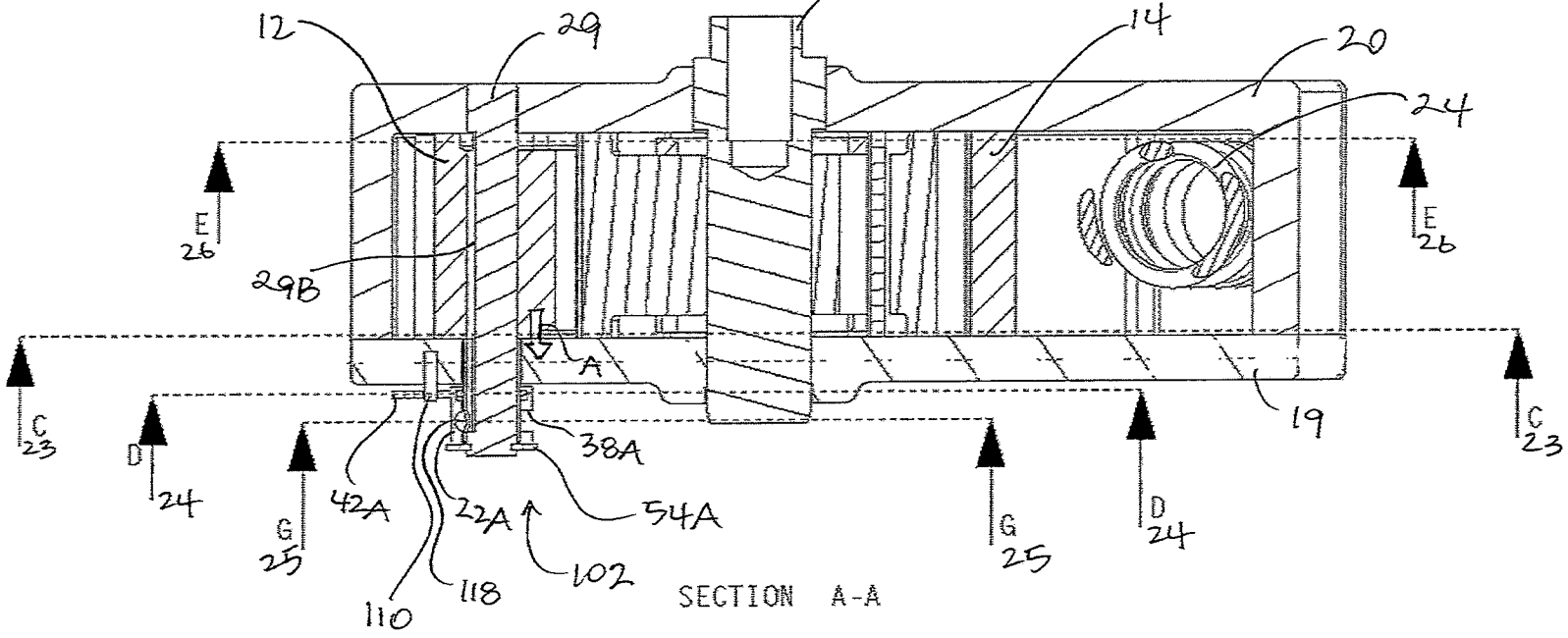
FIG. 21 is a horizontal sectional view taken along line 21-21 in FIG. 20 through the pump housing and control system.

The control device 22A is configured to receive a portion of the pivot pin 29 therein, as shown in FIG. 21, for example. The pivot pin 29 is similar to the previously described pivot pin 28, and provides similar function thereof, but includes a body of an alternate design (e.g., it has additional groove, and each of the grooves are curved as opposed to linear or flat). Further, the pivot pin 29 is configured to act as both a delivery/feed mechanism and a feed back mechanism. Specifically, because the pin 29 is press fit into the slide 12 and in order for pressurized lubricant to pass from the outlet 33, feed to the control system 102, and feed back therefrom, the pivot pin 29 has multiple grooves 29A, 29B, and 29C thereon. The grooves are spaced around the body of the pivot pin 29; however, groove 29B is designed to extend substantially an entire length of the pivot pin 29, while grooves 29A and 29C only extend along part of the length of the pivot pin 29 (see FIG. 27). The outer surfaces of the pivot pin 29 remain in contact with the surface of the control slide 12. For example, with reference to FIG. 26 (which shows the slide in its maximum position), in operation, a pressurized feed of lubricant from outlet port 33 is connected to groove 29B in pivot pin 29, and feeds the pressurized lubricant (upwardly) towards the control device 22A (in the direction of represented by arrow A in the Figures). The pressurized lubricant is directed from groove 29B into a receiving portion 118 (see FIGS. 21 and 25) in the cylindrical housing. The receiving portion 118 of the housing of control device 22A may be in the form of a notch, a groove, or an opening, for example, within the housing. The pressurized lubricant may be optionally fed to grooves 29A and 29C and, depending on the position of the control device 22A—which is described in greater detail below—lubricant is fed (back) to either the first chamber 34 or the second chamber 36.

Figure 22:
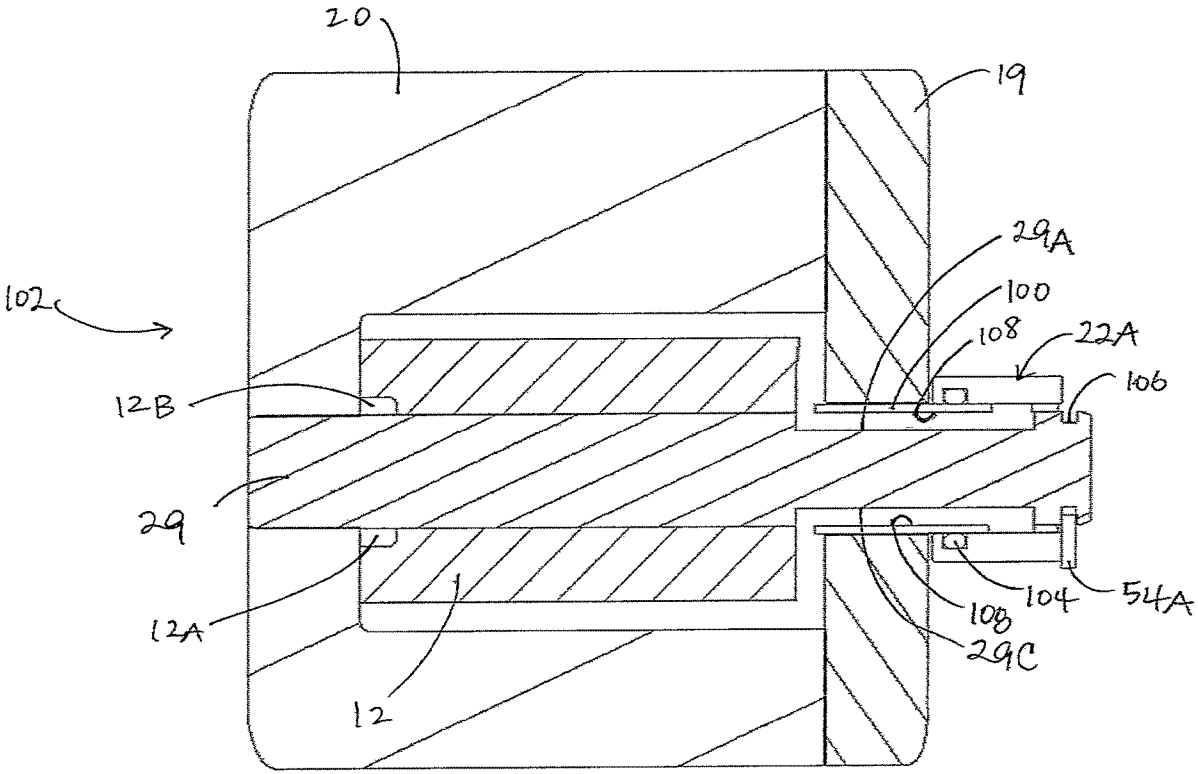
FIG. 22 is a vertical sectional view taken along line 22-22 in FIG. 20 through the control system and part of the pump housing.

As shown in FIG. 22, the pivot pin 29 extends through the cylindrical housing of the control device 22A and is secured at bottom portion thereof. A retention clip 54A (see FIGS. 20-22) is provided in a groove 106 at an end of the pivot pin 29 to retain the positioning of the pivot pin 29 relative to the cylindrical housing of the control device 22A. The control device 22A is configured for movement or rotation about the same axis as the pivot pin 29 (although it is separate therefrom).

A pivot pin tube 100 is also provided as part of the control device 22A. The tube 100 has a bore therethrough and is rotationally guided within an opening 123 in the cover 19 (or the opening 123 may be formed through another part of the housing 20) that is adjacent to the outlet 40. The tube 100 surrounds and is secured to the pivot pin 29 through its bore and rotationally fixed with the pivot pin 29. For example, the tube 100 may be pressed over the pivot pin 29. The tube 100 is configured to rotate with the pivot pin 29 and thus with the control slide 12 (since the pivot pin 29 is pressed into the control slide 12 and rotationally fixed thereto). Delivery ports or feed port(s) are formed from a combination of the grooves 29A, 29B, and 29C formed in the pivot pin 29 and an inner wall 108 of the tube 100 (i.e., ports are formed between surface(s) of the pivot pin 29 and the inner wall 108). The tube 100 includes openings 112, 114, and 116 (see FIG. 25A and FIG. 27) or ports that are aligned with grooves 29A, 29B, and 29C to allow lubricant to run through the formed feed ports (between surfaces of the pivot pin 29 and the inner wall 108). The openings 112, 114, and 116 may be selectively aligned with the vent port 38A and/or the receiving portion 118 of the control device 22A.

As described in greater detail later, pressurized lubricant may be directed from the outlet 33 and into a receiving portion 118 (see FIGS. 21 and 25) of the cylindrical housing of the control device 22A. The receiving portion 118 may be a groove formed inside the cylindrical housing, for example. This receiving portion is fluidly connected to groove 29B of pivot pin 29.

Also, it is noted that, in addition to the grooves 29A, 29B, and 29C provided in the pivot pin 29, the control slide 12 may include delivery channels 12A and 12B formed therein, shown in FIG. 23, for directing pressurized lubricant to chambers 34, 36. Based on the positioning of the control device 22A, pressurized lubricant may be directed using one of the grooves 29A, 29C, through one of the delivery channels 12A and 12B and into one of the chambers 34, 36.

Additionally, in one embodiment, as seen in FIGS. 21 and 27, a control pin 110 may be provided. The control pin 110 connects the cover 19 and control device 22A as well as controls of the rotation of the control device 22A between at least its first and second control positions, for example. The pin 110 may extend through a wall, hole or slot 113 of the cover 19 (see FIG. 27) and through an elongated hole 111 within the control device 22A (e.g., see FIGS. 24A and 24B). The pin 110 is configured to move between a first end and a second end of the elongated hole 110, which corresponds to a first control position and a second control position of the control device 22A.

Figure 25:
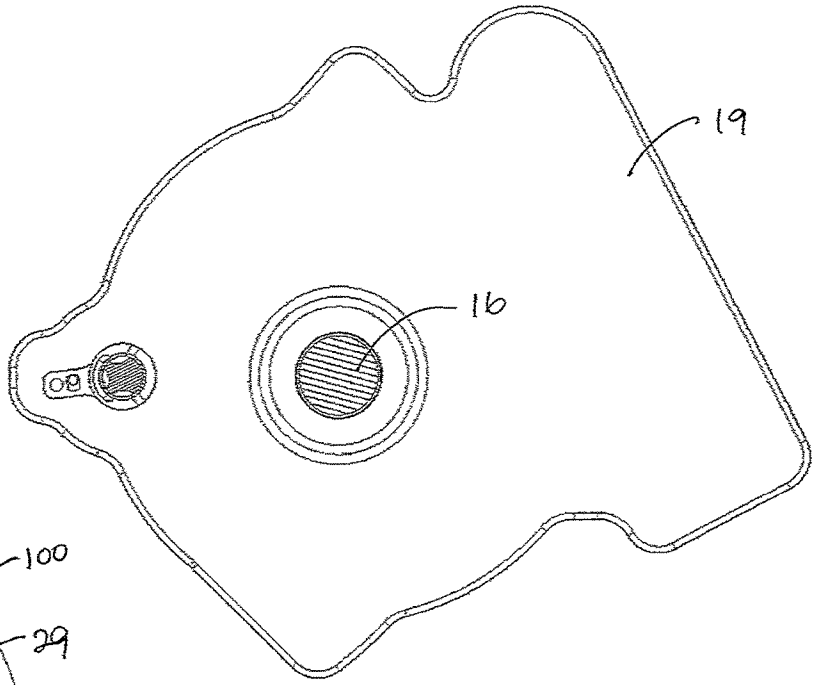
FIG. 25 is a sectional view taken along line 25-25 in FIG. 21 through a second part of the control device of the control system.
Figure 25A:
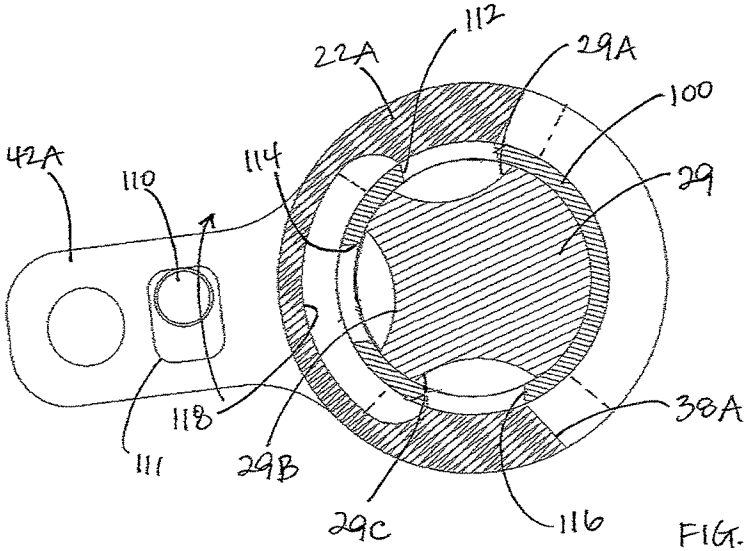
FIG. 25A is a detailed view of parts of the control device as shown in FIG. 25 in a neutral control position.

In each of the positions of the control device 22A, a pressurized feed of lubricant from outlet port 33 is connected to groove 29B in pivot pin 29, and feeds the pressurized lubricant (upwardly) towards the control device 22A (in the direction of represented by arrow A in the FIG. 27). However, the positioning of the control device 22A determines if and where the pressurized lubricant is directed. FIG. 25A is a schematic diagram illustrating the control device 22A in a neutral control position, in accordance with an embodiment. In this neutral position, the openings 112, 114, and 116 of the tube 100 are substantially limited from communicating pressurized lubricant to the grooves 29A and 29C. This is because delivery from the receiving portion 118 is blocked on either side by the positioning of the inner walls of the cylindrical housing about the tube 100 (e.g., the inner walls close off the openings 112 and 116). Accordingly, little to no pressurized lubricant (from the outlet 33) is delivered to either the first control chamber 34 or the second control chamber 36.

Figure 25B:
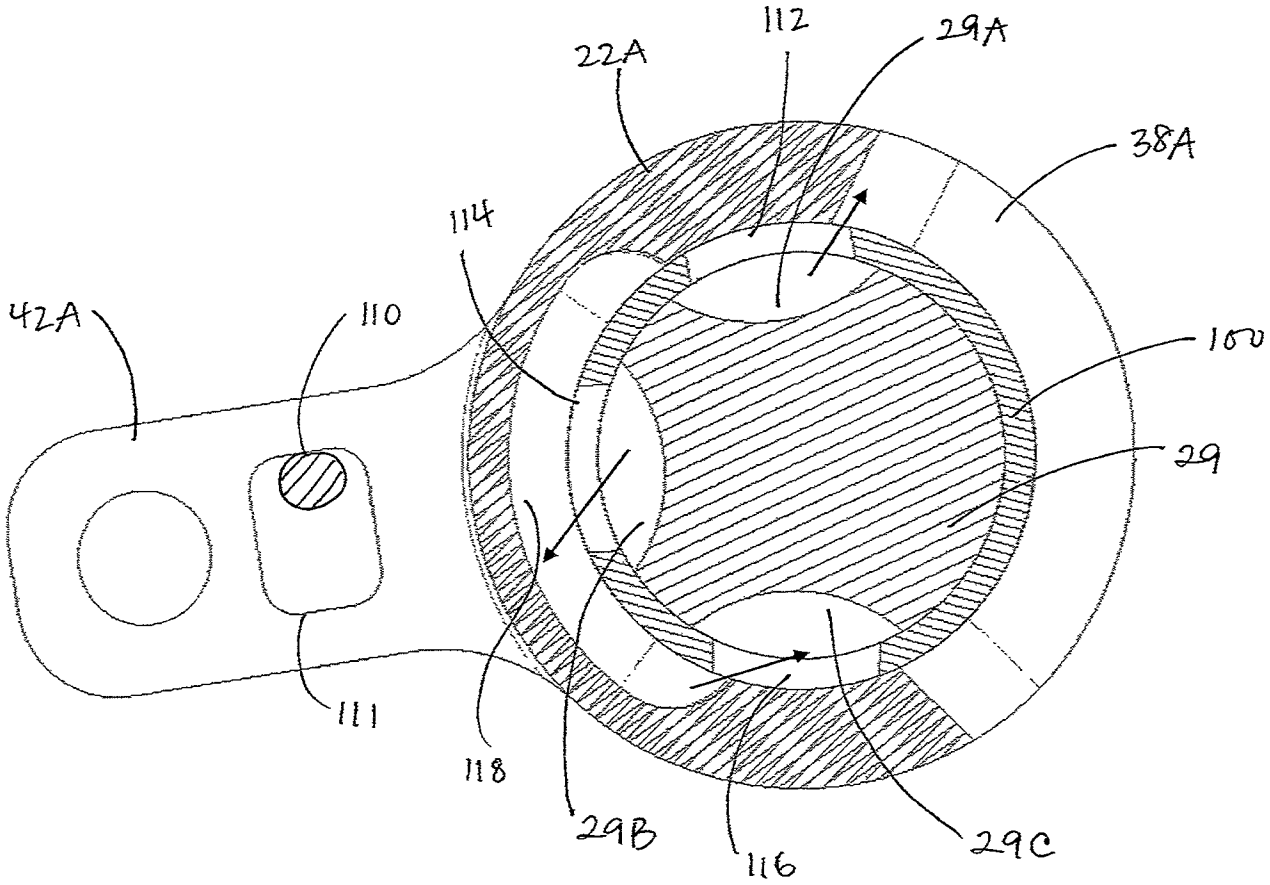
FIGS. 25B and 25C are schematic diagrams illustrating positions of the control device in a first control position (e.g., for increasing displacement) and a second control position (e.g., for decreasing displacement), respectively, for controlling delivery of pressurized lubricant to chambers in the pump, when viewed in a downward direction.
Figure 25C:
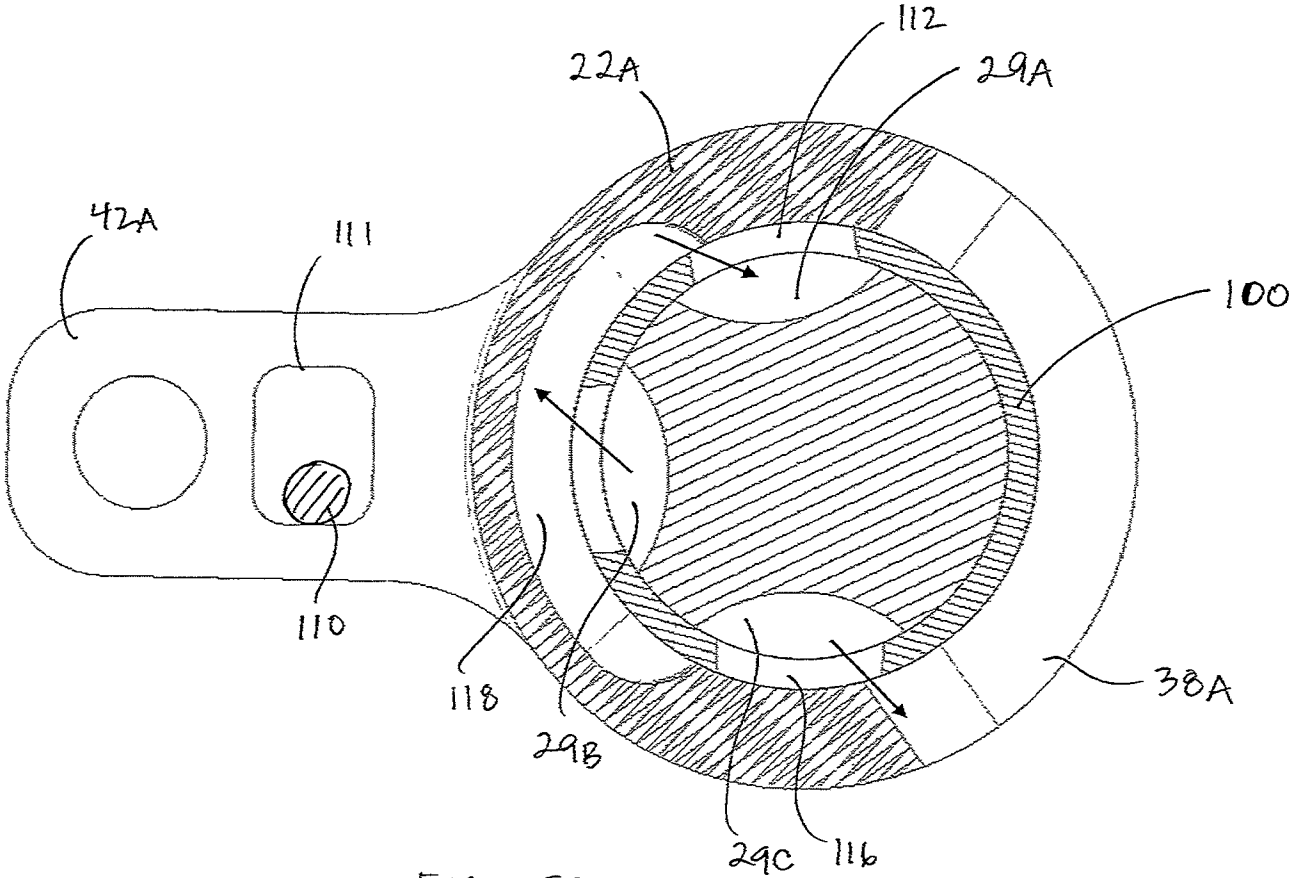
Figure 26:
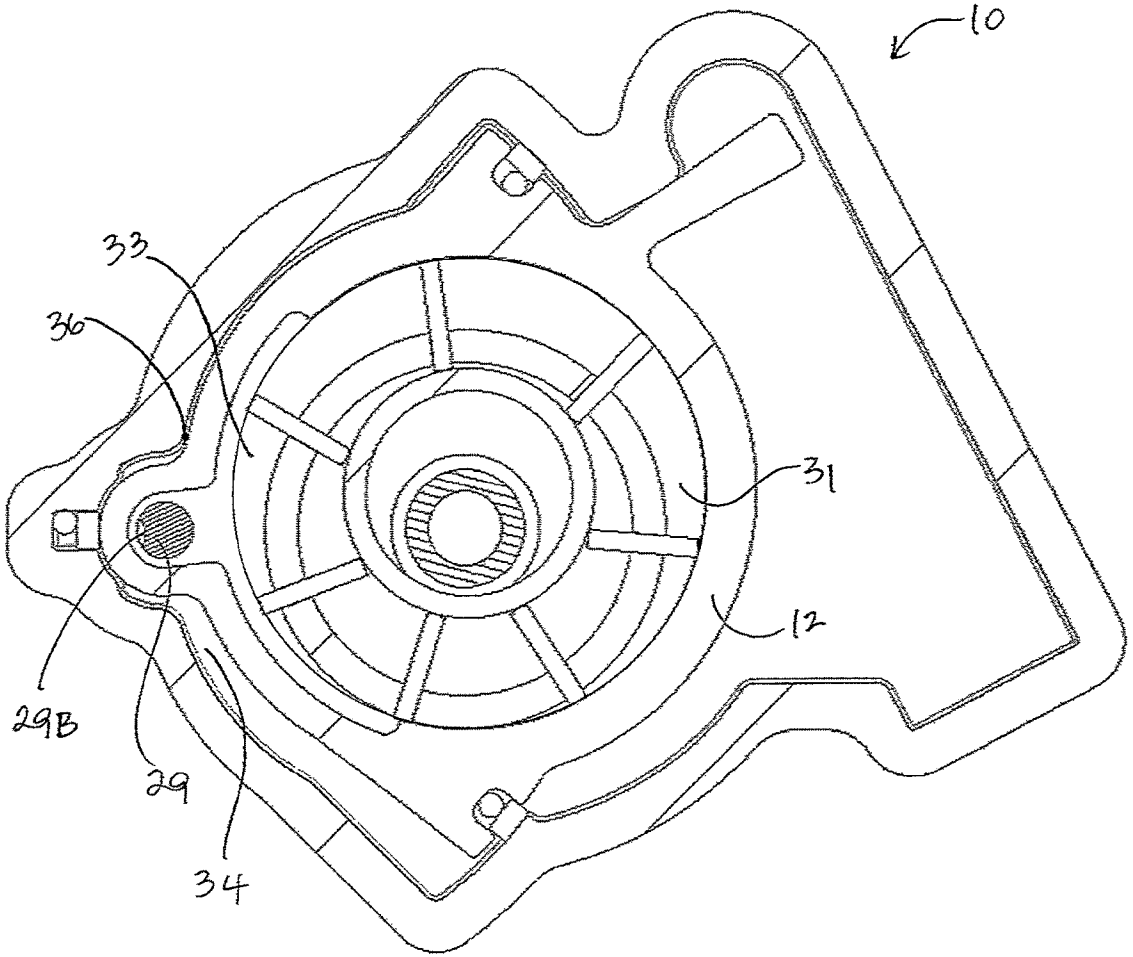
FIG. 26 is a sectional view taken along line 26-26 in FIG. 21 through a second part of the control device of the control system.

Referring now to the operation of directing and feeding the pressurized lubricant using the control device 22A to the chambers, as previously noted, lubricant is fed to receiving portion 118 of the control device 22A. The pressurized lubricant may then be fed to either of grooves 29A or 29C. FIGS. 25B and 25C illustrate relative positions of the control device 22A of the control system 102 in a first control position (FIG. 25B) (e.g., maximum displacement) and a second control position (FIG. 25C)(e.g., minimum displacement), respectively, for controlling delivery of pressurized lubricant to chambers 34, 36 in the pump 10. The positions shown in FIGS. 25B and 25C correspond to their positioning when viewed in a downward direction, i.e., when viewed in the direction indicated by arrow B in FIG. 27. The O-ring 104 allows for sliding movement of the cylindrical housing 22A relative to the tube 100. In the first control position of FIG. 25B, e.g., when the control device 22A is rotated towards or to a maximum displacement position to increase displacement (e.g., counter-clockwise as depicted in FIG.

25B), the pin 110 is provided at a first end of the elongated hole 111. Pressurized lubricant is delivered from groove 29B to receiving portion 118 and then is directed to through opening 116 in tube 100 and into groove 29C. In this first control position, then, pressurized lubricant is delivered to the first control chamber 34 via fluid connection of the port 116 and groove 29C, to thus move the control slide 12 towards its first slide position and to increase output flow of the pump. This may result in a maximum displacement by the pump 10, shown in FIG. 23. The second control chamber 36 vents lubricant (e.g., to the tank 58 or source 26) via fluid connection of the groove 29A and port 112, and out through vent port 38A of the control device 22A.

In the second control position of FIG. 25C, e.g., when the control device 22A is rotated towards or to a minimum displacement position (e.g., clockwise as depicted in FIG. 25C) such that the pin 110 is provided at a second end of the elongated hole 111, pressurized lubricant is delivered from groove 29B to receiving portion 118 and then is directed to through opening 112 in tube 100 and into groove 29A. In this second control position, then, pressurized lubricant is delivered to the second control chamber 36 via fluid connection of the port 112 and groove 29A, to thus move the control slide 12 towards its second slide position and to decrease output flow of the pump. This may result in a maximum displacement by the pump 10, shown in FIG. 23. The first control chamber 34 vents lubricant (e.g., to the tank 58 or source 26) via fluid connection of the groove 29C and port 116, and out through vent port 38A of the control device 22A. This reduces displacement of the control slide 12 and may result in a minimum displacement by the pump.

Accordingly, the control device 22A switches which of the first control chamber 34 and the second control chamber 36 are connected to the outlet port 33 of the pump and the other is connected to vent. This allows a small force to control the pump as the working pressure is provided by the outlet of the pump. Thus, by rotating the control device 22A, some of the pressure is effectively shifted over from the first control chamber 34 to the second control chamber 36 to in turn increase the displacement of the control slide 12 against the resilient structure 24.

The control system 102 returns to a neutral position (FIG. 25) by the fixed rotation of the tube 100 along with the control slide 12. That is, in each case, the movement of the control slide 12 via the delivery of the pressurized lubricant to either chamber 34 or 36 will also move the pivot pin 29 (e.g., clockwise or counterclockwise), which in turn moves/rotates tube 100, since they are rotationally fixed together. For example, as the control slide 12 pivots clockwise, the pivot pin 29 and tube 100 are moved clockwise. The control slide 12 remains biased towards either of its positions (minimum or maximum) until the flow to the chamber 34 and/or 36 is reduced or limited, or until the lever 42A is activated or moved. As the flow is reduced to either chamber or when delivery of the pressurized fluid to the respective chamber is ceased, the slide 12 may be urged back to a relatively neutral position, or a home position. Such slide movement thus turns the pivot pin 29 and tube 100 to a neutral position, to position and align the inner walls of the control device 22A with the grooves of the pivot pin 29 as shown in FIG. 25, for example, thereby substantially limiting or preventing delivery or flow of lubricant from groove 29B and portion 118 to either groove 29C or groove 29A.

Figure 3:
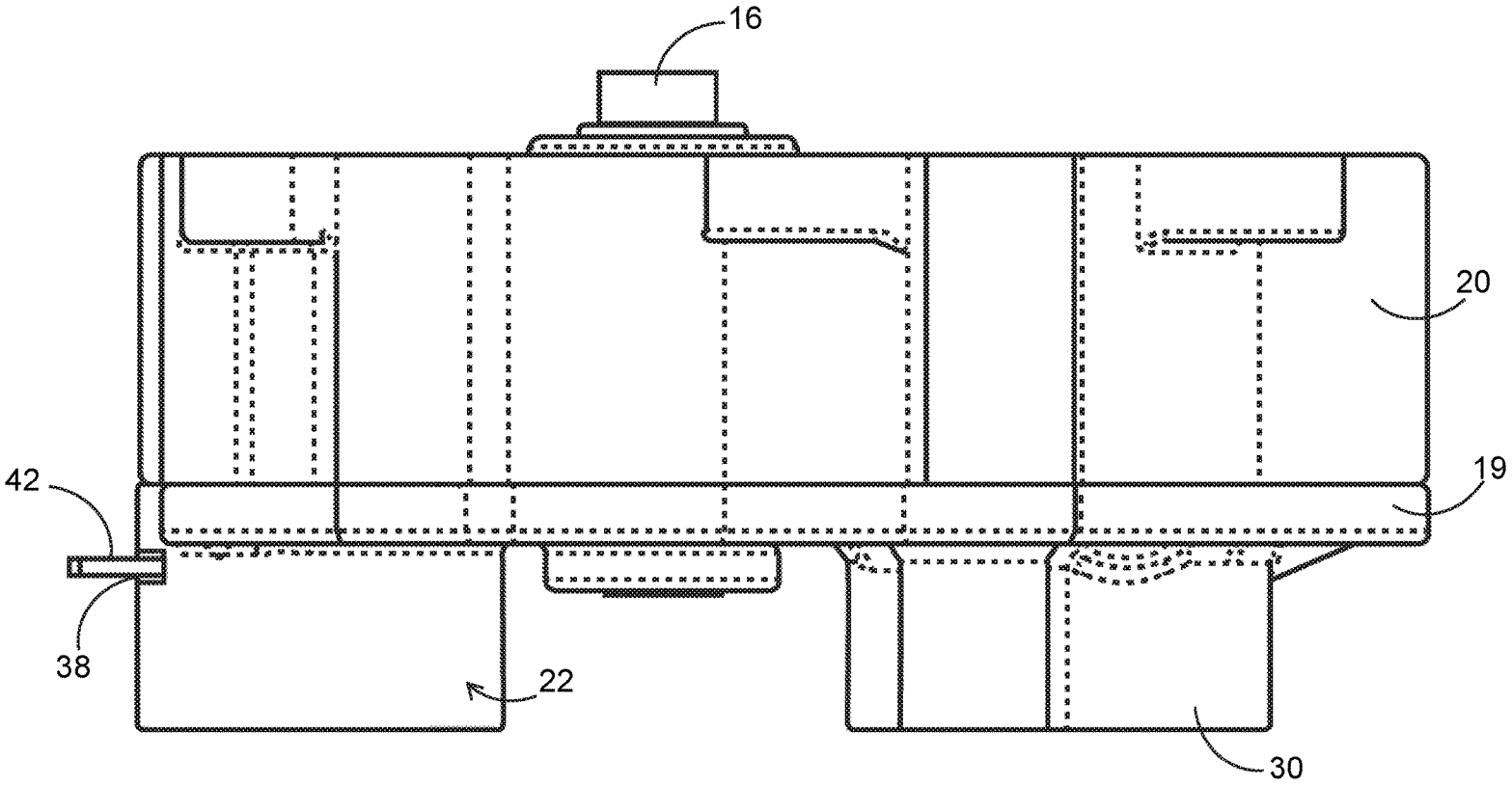
FIGS. 3, 4, and 5 are a side, end, and top views, respectively, of the housing and cover of the pump shown in FIG. 2.
Figure 4:
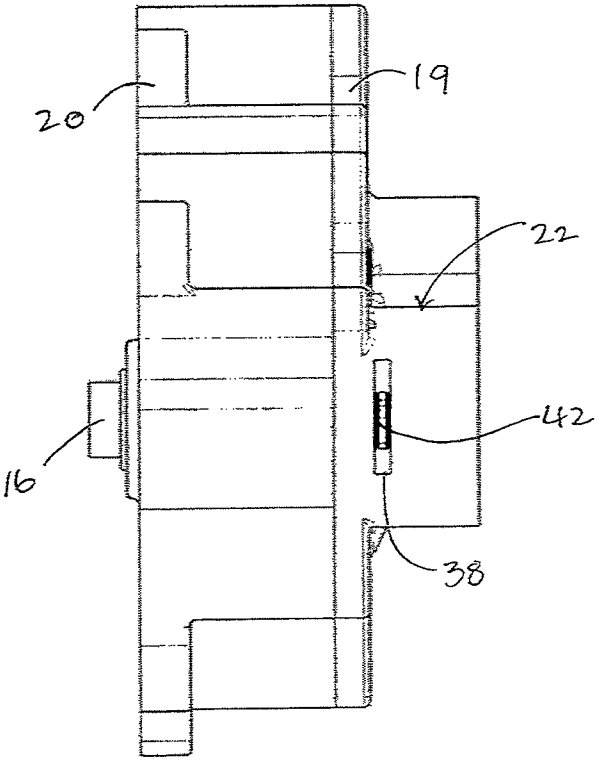
Figure 5:
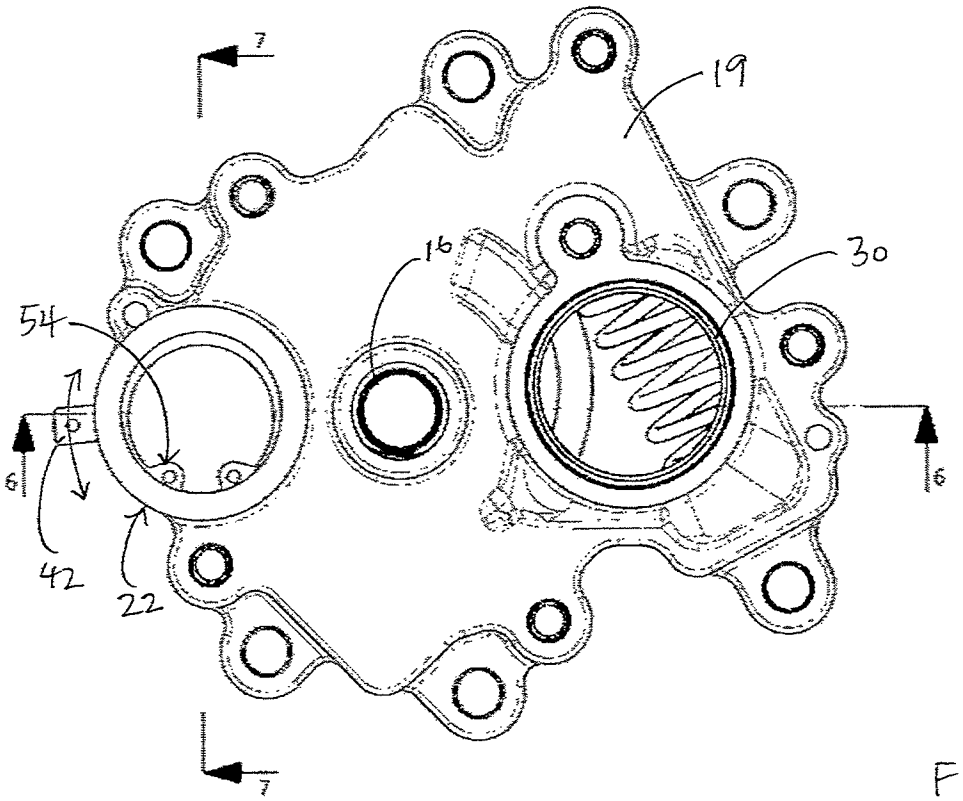
Figure 5A:
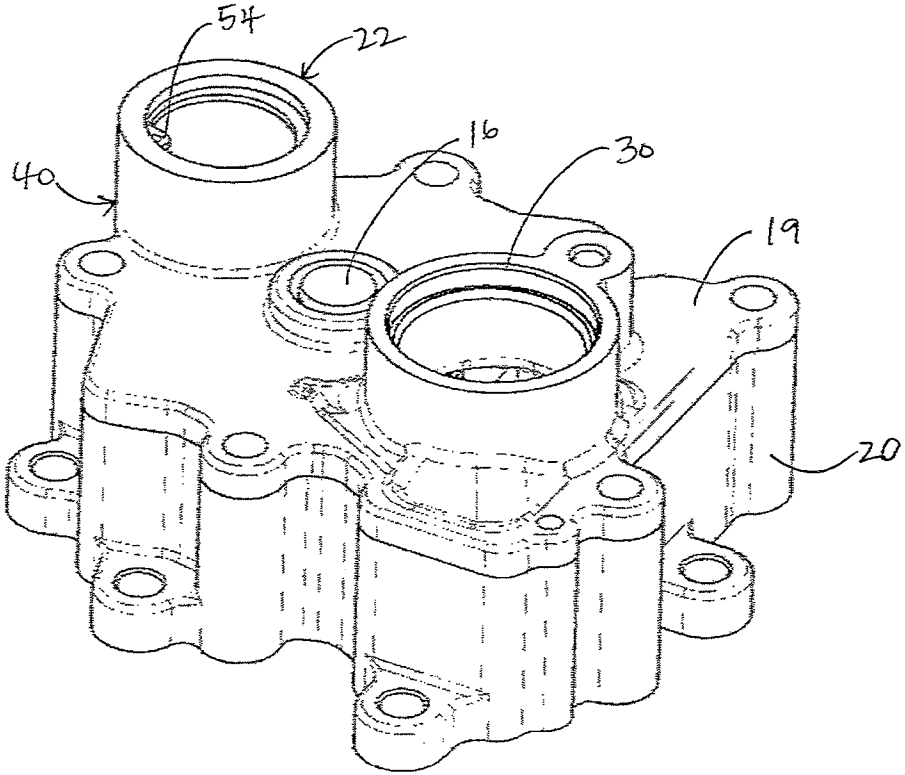
FIGS. 5A and 5B are an exemplary top perspective view and bottom perspective view, respectively, of the pump housing and cover as shown in FIGS. 2-5 with its inlet.
Figure 5B:
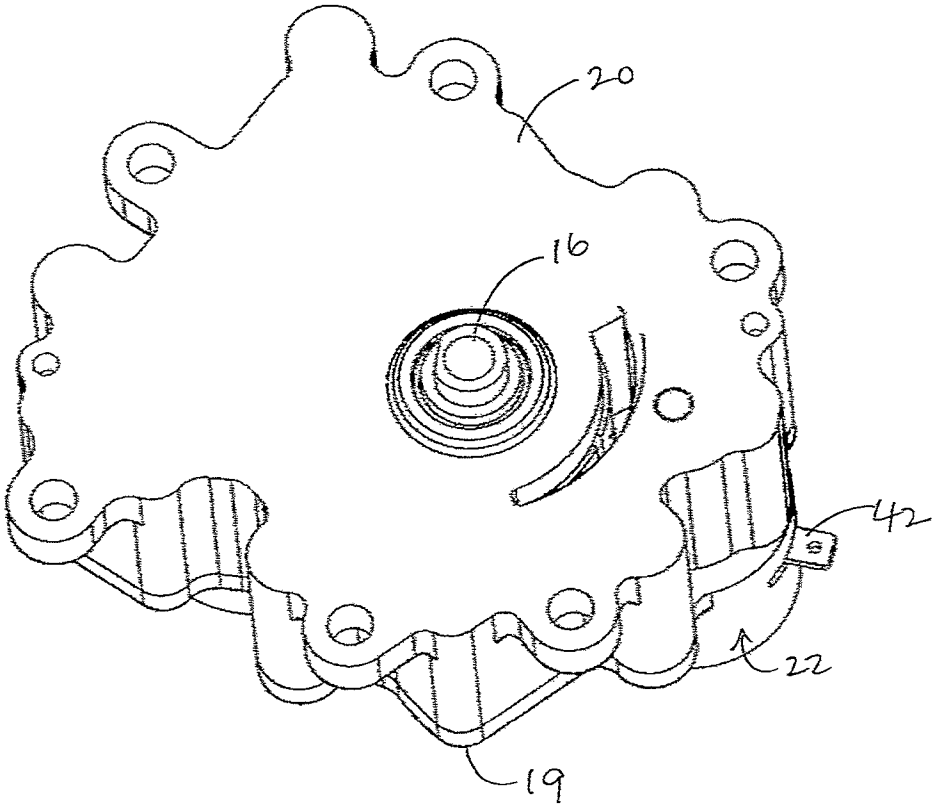

To control movement of the control systems 50 or 102 (e.g., control disc 46 or control device 22A) between its control positions, a number of actuation mechanisms and methods may be implemented. In one embodiment, the control disc 46 also includes a lever 42 that is configured to control rotation of the control disc 46. In a similar manner, the control device 22A may also include a lever 42A for controlling rotation of its housing. The levers 42 and 42A may be rotated back and forth such that their associated control devices adjusts delivery of the pressurized fluid to the control chambers 34, 36, thereby adjusting the position of the control slide 12. In the first illustrated embodiment, the lever 42 may extend through the vent port 38 in the chamber 22, as shown in FIGS. 3-5, for example. In the second illustrated embodiment, the lever 42A may be attached to or formed as a part of (e.g., integrally therewith) the control device 22A. Movement or rotation of the lever may be implemented in any number of ways, including, but not limited to, regulation pressure or an electrical linear, rotational, or angular force device. In accordance with embodiments, use of a linear solenoid, a hydraulic piston and spring, a DC motor, or stepper motor turning a set of gears an axial screw drive for actuation or rotation of the control device is within the scope of this disclosure. The device(s) used to actuate the lever 42 and/or 42A are not intended to be limiting.

Figure 28:
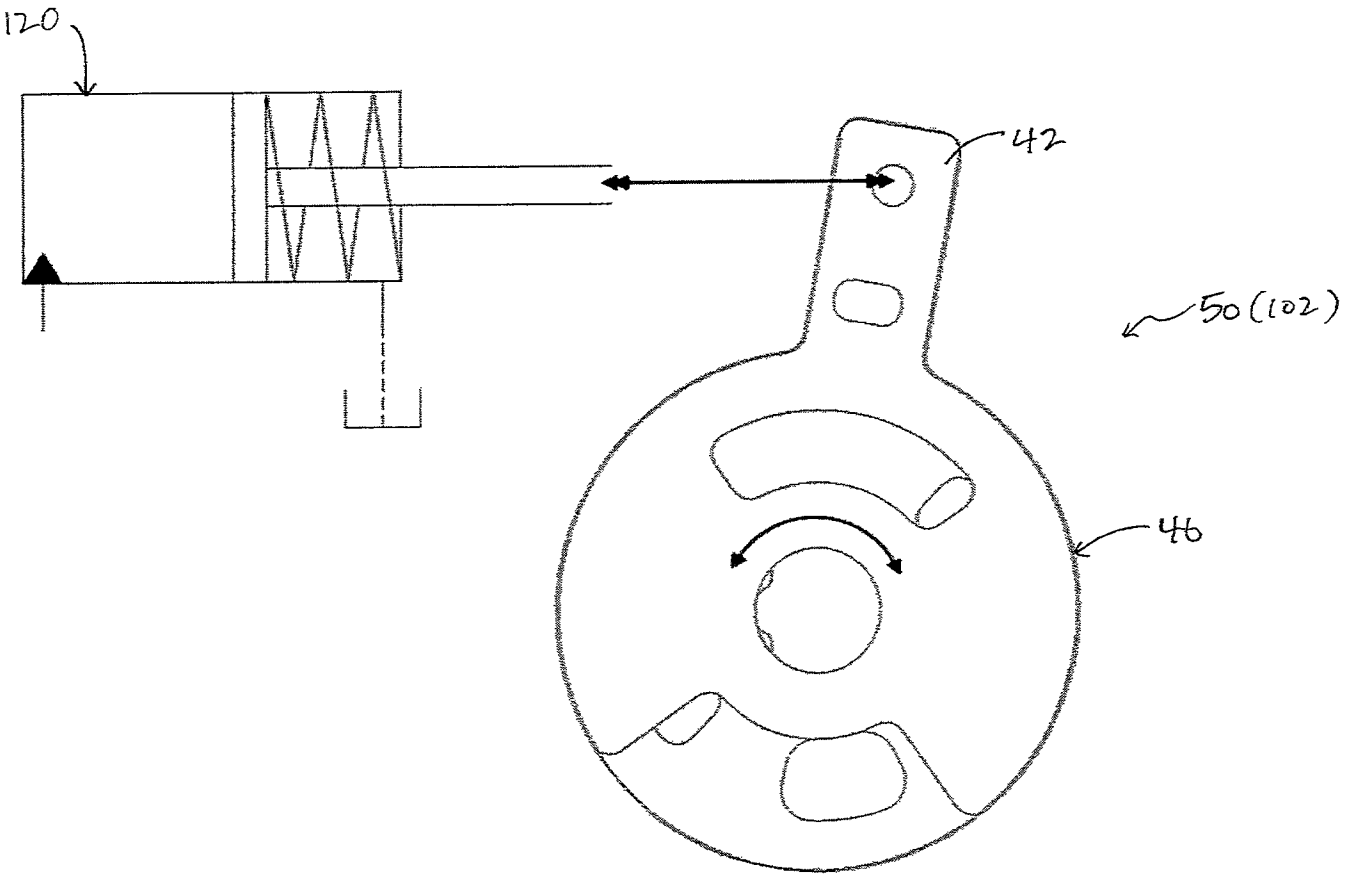
FIGS. 28-30 illustrate exemplary mechanisms and devices for controlling positions of the control devices disclosed in FIG. 2 and FIG. 17, in accordance with embodiments herein.
Figure 29:
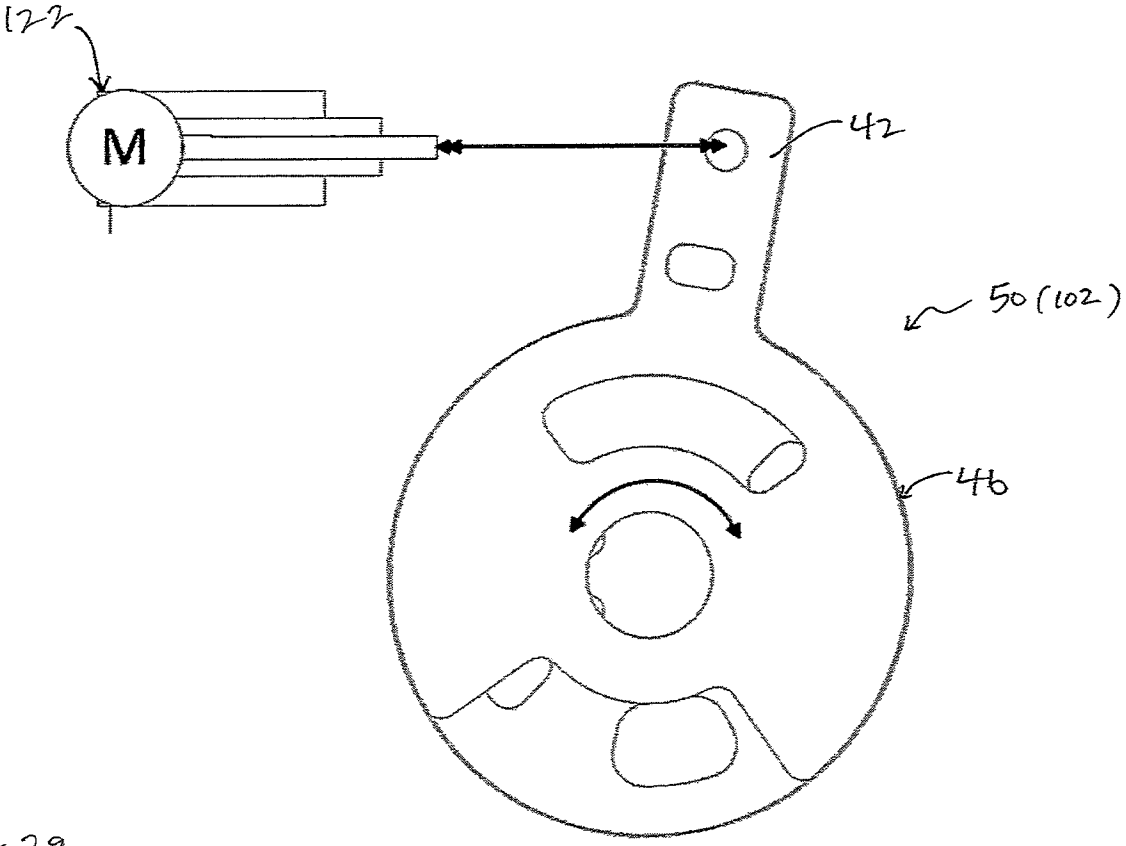
Figure 30:
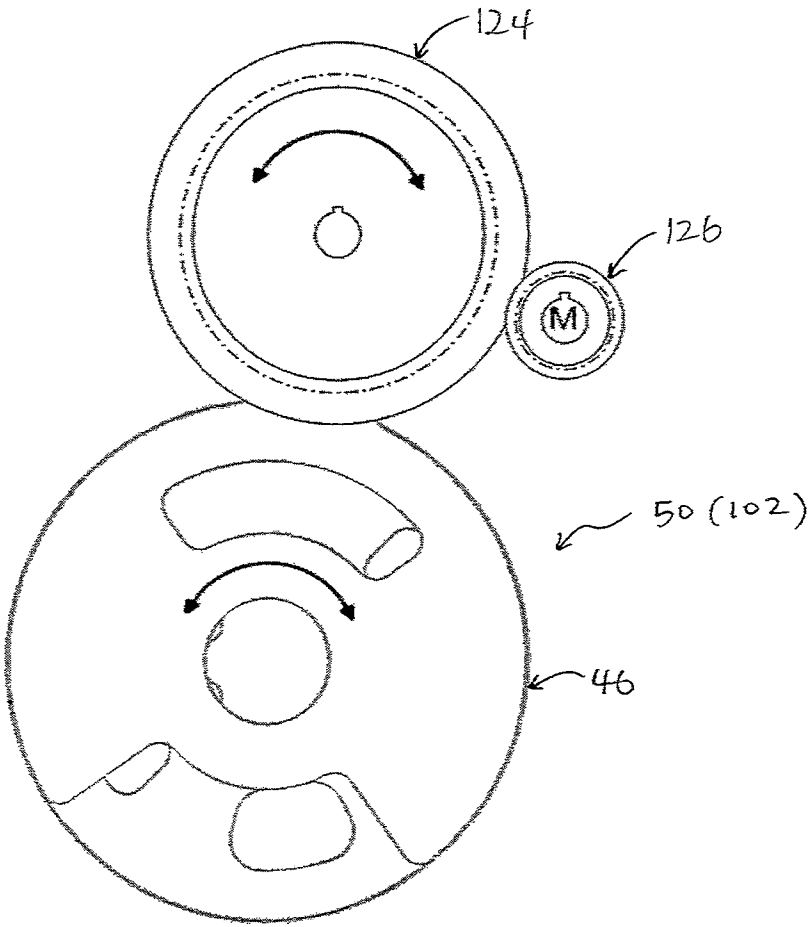

In one embodiment, the movement of the control disc 46 or control device 22A is actuated via hydraulic pressure supplied to the chamber 22. The control pressure can be, for example, the pump outlet pressure or the engine gallery feedback pressure. The control pressure may be used to control parts of the pump so that the desired amount of pressurized lubricant is delivered to the system, e.g., engine. In another embodiment, schematically depicted in FIG. 28, for example, a hydraulic device 120 may be utilized to actuate the control system 50. For example, it may move lever 42A of the control disc 46. FIG. 29 illustrates use of a motor 122 to actuate the control device (e.g., control disc 46) of the control system 50. FIG. 30 illustrates use of a combination of a motor 126 and gearing 124 (e.g., one or more gears) to actuate the control device of the control system 50. Of course, it should be understood that any of the devices of FIGS. 28-30 may be utilized with the housing of control device 22A, although not specifically shown.

In yet another embodiment, movement of the control device is actuated via an electromagnetic device associated therewith. For example, the control disc 46 may contain permanent magnets provided therein that may be actuated (e.g., via application of electric current) for rotation of the control disc 46. Alternatively, the control device 22A may include magnets associated therewith. An increase of current to the magnets may rotate the control device in a first direction, whereas a reduction in current may rotate the control device in a second direction. Springs may be further utilized to assist in rotation of the control device.

Further, it should be noted that a lever 42 and/or 42A or separate part for actuation of the control device of the control system 50 or 102 need not be provided. For example, as schematically depicted in FIG. 31, a control device 130 may be designed for implementing actuation of the control system 50, 102 associated with the pump 10, using, for example, one of exemplary described actuation mechanisms of FIGS. 28-30, in accordance with embodiments herein.

Accordingly, this disclosure further discloses a method for controlling delivery of lubricant to a variable vane pump using the herein disclosed control system 50 or 102. The method includes, for example, moving the control device to the first control position such that pressurized lubricant is delivered to the first control chamber 34, thereby moving the control slide 12 towards its first slide position, increasing the output flow of the pump, and moving the feedback disc 44 along with the control slide 12 towards the first slide position. The method may include, for example, moving the control device to the second control position such that pressurized lubricant is delivered to the second control chamber 36, thereby moving the control slide 12 towards its second slide position, increasing the output flow of the pump, and moving the feedback disc 44 along with the control slide 12 towards the second slide position.

In both embodiments disclosed herein, the pressurized outlet lubricant (or oil) is used directly from the outlet port and is directed to the control system. The control system directs the pressurized lubricant to either the decrease chamber (second chamber 36), or the increase chamber (first chamber 34). Whichever chamber is not pressurized, will be vented. The selection of which chamber to pressurize is performed by rotating the control device, for example. The pressurized lubricant will thus rotate the control slide about the pivot pin (which is press fit with the slide for rotation movement therewith). The pivot pin rotates the control ports until it is at a neutral state with the control device (the position at which neither port is pressurized or vented).

The control system positions the control slide to the same angle as the control device (e.g., as the control plate), and is a pilot that requires very little torque as the fluid pressure from the pump actuates and performs the slide movement.

Further, the disclosed control system and control device may assist in providing a fail safe function to the pump, such as during cold start. In fail safe regulation mode, for example, when the electrical valve associated with the pump function is disabled, the control device can be controlled (e.g., channels and vents can be opened and closed) based on the selective movement of the valve. Accordingly, the disclosed embodiments may result in fuel savings at cold start and a quick response of the pump during the cold start.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will thus be seen that the features of this disclosure have been fully and effectively accomplished. It will be realized, however, that the foregoing preferred specific embodiments have been shown and described for the purpose of illustrating the functional and structural principles of this disclosure and are subject to change without departure from such principles. Therefore, this disclosure includes all modifications encompassed within the spirit and scope of the following claims.

What is claimed is:

1. A variable displacement vane pump for dispensing lubricant to a system, comprising:

a housing;

an inlet for inputting the lubricant from a source into the housing;

an outlet for delivering the lubricant to the system from the housing;

a control slide displaceable about a pivot pin within the housing between a first slide position and a second slide position to adjust displacement of the pump through the outlet;

a resilient structure biasing the control slide in a first direction towards the first slide position;

a rotor with at least one vane mounted in the housing and configured for rotation within and relative to the control slide, the at least one vane configured for engagement within an inside surface of the control slide during rotation thereof;

a first control chamber between the housing and the control slide provided on one side of the pivot pin such that supplying the lubricant to the first control chamber urges the control slide in the first direction towards the first slide position;

a second control chamber between the housing and the control slide provided on the other side of the pivot pin such that supplying the lubricant to the second control chamber urges the control slide in a second direction opposite the first direction towards the second slide position;

a control system controlling delivery of the lubricant to the first and second control chambers of the pump, the control system comprising a control device positioned in axial alignment with and intersecting an axis of the pivot pin and being mounted to permit pivotal movement about said axis between at least a first control position and a second control position;

the control device having a feed port communicated to the lubricant and a vent port;

wherein, in the first control position, the feed port of the control device is configured to deliver the lubricant to the first control chamber and the vent port of the control device is configured to vent the second control chamber, thereby moving the control slide in the first direction towards its first slide position and increasing the output flow of the pump, and wherein, in the second control position, the feed port of the control device is configured to deliver the lubricant to the second control chamber and the vent port of the control device is configured to vent the first control chamber, thereby moving the control slide in the second direction towards its second slide position and decreasing the output flow of the pump.

2. The variable displacement vane pump according to claim 1, wherein the control device is movable into a neutral position such that delivery of the lubricant to either of the first control chamber or the second control chamber via the control system is substantially prevented.

3. The variable displacement vane pump according to claim 1, wherein the control system further comprises a feedback plate rotationally fixed to the pivot pin of the control slide for movement along with the control slide, and wherein the control device is a control plate mounted for movement relative to the feedback plate, the feedback plate having a first port communicated to the first control chamber and a second port communicated to the second control chamber;

wherein, in the first control position, the feed port of the control plate is communicated to the first port of the feedback plate such that the lubricant is delivered to the first control chamber and the vent port of the control plate is communicated to the second port of the feedback disc to vent the second control chamber, and wherein, in the second control position, the feed port of the control plate is communicated to the second port of the feedback plate such that the pressurized lubricant is delivered to the second control chamber and the vent port of the control plate is communicated to the first port of the feedback plate to vent the first control chamber.

4. The variable displacement vane pump according to claim 3, wherein the feedback plate and control plate are axially aligned and provided within a bore of a chamber associated with the housing.

5. The variable displacement vane pump according to claim 2, wherein the movement of the control device is actuated via hydraulic pressure.

6. The variable displacement vane pump according to claim 2, wherein the movement of the control device is actuated via a motor.

7. The variable displacement vane pump according to claim 4, further comprising an additional plate within the chamber that is configured to hold the feedback plate and control plate together axially via pressure from delivery of the lubricant to the chamber.

8. The variable displacement pump according to claim 3, further comprising a retention clip configured to axially compress the feedback plate and the control plate together.

9. The variable displacement vane pump according to claim 1, wherein the control system comprises a chamber for receipt of a portion of the pivot pin therein.

10. The variable displacement vane pump according to claim 1, wherein the pivot pin comprises a plurality of grooves provided along a length thereof to direct the lubricant towards the control system.

11. The variable displacement vane pump according to claim 10, wherein the pivot pin is press fit into the control slide.

12. The variable displacement vane pump according to claim 10, further comprising a tube rotationally fixed with the pivot pin and configured for rotation therewith, the tube comprising openings for directing the lubricant to or from the plurality of grooves, the openings being aligned with the plurality of grooves of the pivot pin.

13. The variable displacement vane pump according to claim 10, wherein the control device comprises a substantially cylindrical housing, and wherein the vent port is formed from an opening provided through a wall of the substantially cylindrical housing.

14. A variable displacement vane pump for dispensing lubricant to a system, comprising:

a housing;

an inlet for inputting lubricant from a source into the housing;

an outlet for delivering the lubricant to the system from the housing;

a control slide displaceable about a pivot pin within the housing between a first slide position and a second slide position to adjust displacement of the pump through the outlet;

a resilient structure biasing the control slide in a first direction towards the first slide position;

a rotor with at least one vane mounted in the housing and configured for rotation within and relative to the control slide, the at least one vane configured for engagement within an inside surface of the control slide during rotation thereof;

a first control chamber between the housing and the control slide provided on one side of the pivot pin such that supplying the lubricant to the first control chamber urges the control slide in the first direction towards the first slide position;

a second control chamber between the housing and the control slide provided on the other side of the pivot pin such that supplying the lubricant to the second control chamber urges the control slide in a second direction opposite the first direction towards the second slide position;

a control system controlling delivery of the lubricant to the first and second control chambers of the pump, the control system comprising a chamber for receipt of a portion of the pivot pin therein and a control device positioned adjacent to the pivot pin and being mounted to permit pivotal movement between at least a first control position and a second control position;

the control device having a feed port communicated to the lubricant and a vent port;

wherein, in the first control position, the feed port of the control device is configured to deliver the lubricant to the first control chamber and the vent port of the control device is configured to vent the second control chamber, thereby moving the control slide in the first direction towards its first slide position and increasing the output flow of the pump, and wherein, in the second control position, the feed port of the control device is configured to deliver the lubricant to the second control chamber and the vent port of the control device is configured to vent the first control chamber, thereby moving the control slide in the second direction towards its second slide position and decreasing the output flow of the pump.

15. The variable displacement vane pump according to claim 14, wherein the control system further comprises a feedback plate rotationally fixed to the pivot pin of the control slide for movement along with the control slide, and wherein the control device is a control plate mounted for movement relative to the feedback plate, the feedback plate having a first port communicated to the first control chamber and a second port communicated to the second control chamber;

wherein, in the first control position, the feed port of the control plate is communicated to the first port of the feedback plate such that the lubricant is delivered to the first control chamber and the vent port of the control plate is communicated to the second port of the feedback disc to vent the second control chamber, and wherein, in the second control position, the feed port of the control plate is communicated to the second port of the feedback plate such that the pressurized lubricant is delivered to the second control chamber and the vent port of the control plate is communicated to the first port of the feedback plate to vent the first control chamber.

16. The variable displacement vane pump according to claim 14, wherein the movement of the control device is actuated via hydraulic pressure or via a motor.

17. A variable displacement vane pump for dispensing lubricant to a system, comprising:

a housing;

an inlet for inputting lubricant from a source into the housing;

an outlet for delivering the lubricant to the system from the housing;

a control slide displaceable about a pivot pin within the housing between a first slide position and a second slide position to adjust displacement of the pump through the outlet;

a resilient structure biasing the control slide in a first direction towards the first slide position;

a rotor with at least one vane mounted in the housing and configured for rotation within and relative to the control slide, the at least one vane configured for engagement within an inside surface of the control slide during rotation thereof;

a first control chamber between the housing and the control slide provided on one side of the pivot pin such that supplying the lubricant to the first control chamber urges the control slide in the first direction towards the first slide position;

a second control chamber between the housing and the control slide provided on the other side of the pivot pin such that supplying the lubricant to the second control chamber urges the control slide in a second direction opposite the first direction towards the second slide position;

a control system controlling delivery of the pressurized lubricant to the first and second control chambers of the pump, the control system comprising a control device positioned adjacent to the pivot pin and being mounted to permit pivotal movement between at least a first control position and a second control position;

the control device having a feed port communicated to the lubricant and a vent port;

wherein, in the first control position, the feed port of the control device is configured to deliver the lubricant to the first control chamber and the vent port of the control device is configured to vent the second control chamber, thereby moving the control slide in the first direction towards its first slide position and increasing the output flow of the pump, wherein, in the second control position, the feed port of the control device is configured to deliver the lubricant to the second control chamber and the vent port of the control device is configured to vent the first control chamber, thereby moving the control slide in the second direction towards its second slide position and decreasing the output flow of the pump, and wherein the pivot pin comprises a plurality of grooves provided along a length thereof to direct the lubricant towards the control system.

18. The variable displacement vane pump according to claim 17, wherein the pivot pin is press fit into the control slide.

19. The variable displacement vane pump according to claim 17, further comprising a tube rotationally fixed with the pivot pin and configured for rotation therewith, the tube comprising openings for directing the lubricant to or from the plurality of grooves, the openings being aligned with the plurality of grooves of the pivot pin.

20. The variable displacement vane pump according to claim 17, wherein the control device comprises a substantially cylindrical housing, and wherein the vent port is formed from an opening provided through a wall of the substantially cylindrical housing.

* * * * *